US012082705B2

(12) United States Patent
Eglinton et al.

(10) Patent No.: US 12,082,705 B2
(45) Date of Patent: Sep. 10, 2024

(54) MODULAR FURNITURE ASSEMBLY AND ASSOCIATED METHOD OF ASSEMBLY

(71) Applicant: Flexsteel Industries, Inc., Dubuque, IA (US)

(72) Inventors: Alek Eglinton, Dubuque, IA (US); Tyler Bond, Dublin, GA (US)

(73) Assignee: Flexsteel Industries, Inc., Dubuque, IA (US)

( * ) Notice: Subject to any disclaimer, the term of this patent is extended or adjusted under 35 U.S.C. 154(b) by 0 days.

(21) Appl. No.: 17/869,391

(22) Filed: Jul. 20, 2022

(65) Prior Publication Data

US 2023/0038420 A1 Feb. 9, 2023

Related U.S. Application Data

(60) Provisional application No. 63/230,639, filed on Aug. 6, 2021.

(51) Int. Cl.

| | |
|---|---|
| ***A47C 4/02*** | (2006.01) |
| ***A47C 13/00*** | (2006.01) |
| ***A47C 15/00*** | (2006.01) |

(52) U.S. Cl.

CPC ..... *A47C 4/02* (2013.01); *A47C 13/005* (2013.01); *A47C 15/002* (2013.01)

(58) Field of Classification Search

CPC ..... A47C 13/005; A47C 4/02; A47C 15/002

See application file for complete search history.

(56) References Cited

U.S. PATENT DOCUMENTS

| | | | | |
|---|---|---|---|---|
| 3,608,959 | A * | 9/1971 | Sarvas | A47C 4/028 297/440.15 |
| 3,944,281 | A * | 3/1976 | Piretti | A47C 17/045 297/440.14 |
| 4,711,495 | A | 12/1987 | Magder | |
| 5,265,939 | A | 11/1993 | Self et al. | |
| 5,352,017 | A * | 10/1994 | Berning | A47C 13/005 297/440.1 |
| 5,520,437 | A | 5/1996 | LaPointe et al. | |
| 5,544,938 | A | 8/1996 | Saul et al. | |
| 6,367,880 | B1 | 4/2002 | Niederman et al. | |
| 6,595,592 | B1 | 7/2003 | Wieland et al. | |
| 6,932,428 | B2 | 8/2005 | Murphy | |

(Continued)

FOREIGN PATENT DOCUMENTS

| | | |
|---|---|---|
| AU | 2006201979 B2 | 2/2007 |
| CN | 201022532 Y | 2/2008 |

(Continued)

OTHER PUBLICATIONS

Design U.S. Appl. No. 29/846,928, entitled "Modular Furniture Corner," filed Jul. 20, 2022.

(Continued)

*Primary Examiner* — Timothy J Brindley

(74) *Attorney, Agent, or Firm* — Frost Brown Todd LLP

(57) ABSTRACT

A modular furniture assembly includes a base, a back, a removable seat, and a first bracket. The base defines an interior cavity. The first bracket includes first and second portions. The first portion is configured to connect the back with the base. The second portion is configured to support the removable seat within the interior cavity of the base.

18 Claims, 25 Drawing Sheets

(56) References Cited

U.S. PATENT DOCUMENTS

| | | | | |
|---|---|---|---|---|
| 7,213,885 | B2 * | 5/2007 | White, III | A47C 4/028 297/440.16 |
| 7,240,967 | B2 | 7/2007 | Wade | |
| 7,419,220 | B2 | 9/2008 | White, III et al. | |
| 7,806,474 | B2 | 10/2010 | Wahl et al. | |
| 8,511,752 | B2 | 8/2013 | Grove | |
| 8,783,778 | B2 * | 7/2014 | Nelson | A47C 13/005 403/395 |
| 9,028,003 | B2 | 5/2015 | Yeh | |
| 9,103,397 | B2 | 8/2015 | Maas | |
| 10,123,623 | B2 | 11/2018 | Nelson et al. | |
| 10,154,733 | B2 | 12/2018 | Nelson et al. | |
| 10,182,659 | B2 | 1/2019 | Kuhl et al. | |
| 10,806,261 | B2 | 10/2020 | Nelson et al. | |
| 11,109,685 | B1 * | 9/2021 | Yang | A47C 7/34 |
| 11,297,949 | B1 * | 4/2022 | Galjour | A47C 4/028 |
| 11,659,936 | B2 * | 5/2023 | Nelson | A47C 19/005 5/181 |
| 2004/0021359 | A1 * | 2/2004 | Chang | A47C 4/024 297/440.15 |
| 2004/0095000 | A1 | 5/2004 | Durling | |
| 2010/0270844 | A1 | 10/2010 | Hood | |
| 2013/0283587 | A1 * | 10/2013 | Mehringer | A47B 87/007 403/20 |
| 2022/0000266 | A1 * | 1/2022 | Nelson | A47C 13/005 |
| 2022/0104627 | A1 * | 4/2022 | Caron | A47C 13/005 |
| 2022/0240678 | A1 * | 8/2022 | Stack | A47C 13/005 |
| 2023/0210267 | A1 * | 7/2023 | Song | A47C 17/86 5/12.1 |

FOREIGN PATENT DOCUMENTS

| | | | |
|---|---|---|---|
| DE | 29502503 | U1 | 4/1995 |
| DE | 202009007814 | U1 | 8/2009 |
| ES | 1052462 | U | 12/2002 |
| FR | 2293168 | A1 | 7/1976 |
| JP | S53-006411 | U | 1/1978 |
| JP | H08-173266 | A | 7/1996 |
| JP | H11-151133 | A | 6/1999 |
| JP | 2002-045256 | A | 2/2002 |
| TW | 476265 | U | 2/2002 |
| TW | M515327 | U | 11/2016 |
| WO | WO 2001/064081 | A1 | 9/2001 |
| WO | WO 2006/005250 | A1 | 1/2006 |

OTHER PUBLICATIONS

Design U.S. Appl. No. 29/846,937, entitled "Modular Furniture Bracket," filed Jul. 20, 2022.

* cited by examiner

MODULAR FURNITURE ASSEMBLY AND ASSOCIATED METHOD OF ASSEMBLY

PRIORITY

This application claims priority to U.S. Provisional Patent App. No. 63/230,639, entitled "Interlocking Ready to Assemble and Disassemble Furniture with Spring Suspension," filed Aug. 6, 2021, the disclosure of which is incorporated by reference herein.

BACKGROUND

Modular furniture assemblies combining individual modules or sections have become increasingly popular. However, it may be difficult to join separate modules or sections in a straightforward, quick, and robust manner. For example, differences in the construction of the individual modules and/or the substantial weight of the completed modular furniture assembly may make this assembly difficult.

Additionally, it is beneficial to optimize the assembly and disassembly of knock down furniture while utilizing a suitable suspension to enhance the comfort of the users while using the modular furniture assembly. This may improve compactness for shipping, ease of manufacture, ease of assembly, ease of disassembly, and structural rigidity.

Complex high-strength connectors may be used to form a rigid connection between elements. However, complex high-strength connectors add intricacy and may increase the requisite strength requirements for the component parts. For example, complex high-strength connectors may utilize a high-strength frame, such as a steel frame, for all components. High-strength frames may make disassembly difficult, add component and shipping cost, and add weight. The loads imposed by lifting the end of a sectional sofa unit cause flexing, thereby misaligning the reclining mechanism, or causing other difficulties. The weight of components may make the modular furniture assembly less desirable to a user who seeks to rearrange the components or needs to move the modular furniture assembly between rooms or residences.

As a result, it remains desirable to connect individual furniture modules or components together in an effective and straightforward manner while providing suitable comfort during use. As a result, it is desirable to improve the functionality and usability of modular furniture assemblies. However, it is believed that no one prior to the inventor has made or used the invention described in the appended claims.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention.

Figure 2:
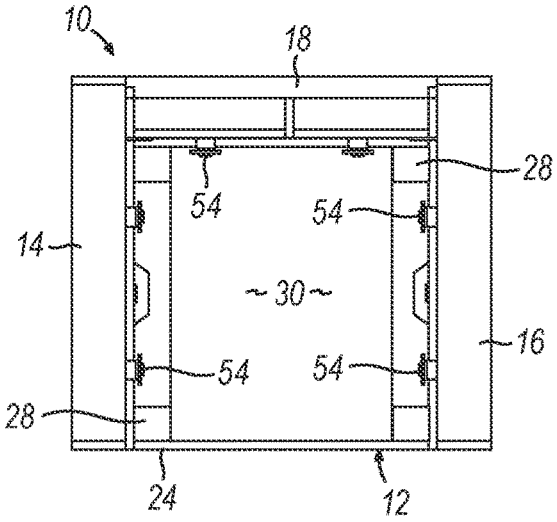
FIG. 2 depicts a top plan view of the modular furniture assembly of FIG. 1, but with the suspension assembly and the bottom cushion removed to expose a cavity within the base.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

To the extent that spatial terms such as "left," "right," "upper," "lower," "vertical," "horizontal," "top," "bottom," or the like are used herein with reference to the drawings, it will be appreciated that such terms are used for exemplary description purposes only and are not intended to be limiting or absolute. In that regard, it will be understood that devices such as those disclosed herein may be used in a variety of orientations and positions not limited to those shown and described herein. Further, the terms "about" and "approximately" as used herein for any numerical values or ranges indicate a suitable dimensional tolerance that allows the part or collection of components to function for its intended purpose as described herein.

I. EXEMPLARY MODULAR FURNITURE ASSEMBLIES

A first exemplary modular furniture assembly (10) is described below with in the form of a chair having a base (12), right and left arms (14, 16) and a back (18). A removable suspension assembly (20) completes the chair structure. The individual components may be upholstered, and further include one or more cushions (22). An advantage of the arrangement is the removability and interlockability of the individual components. For example, a single base (12), suspension assembly (20), and cushion (22) may function as an ottoman. Alternatively, two bases (12), two backs (18), and right and left arms (14, 16) may function as a loveseat. Additionally, three bases (12) and backs (18) two backs (18), and right and left arms (14, 16) may function as a sofa. Combinations and orientations function as a traditional sectional sofa with additional alternative combinations functioning as modern soft seating.

A. First Exemplary Modular Furniture Assembly

1. Removable Suspension Assembly

A suspension assembly (20) may be dropped into (i.e., set into) and removed from a base (12). In other words, suspension assembly (20) may support the weight of the user and includes handles (26) for removal. Suspension assembly (20) rests on top of a series of supports (28) and the space (30) below said series of supports (28) can be used for storage and connections underneath the suspension assembly (20).

Suspension assembly (20) is able to accommodate different suspension types, preferable leaf spring or combined springs, such as those described in U.S. Pat. No. 9,103,397, entitled "Double Spring Function Upholstered Furniture Spring Assemblies," issued Aug. 11, 2015, the disclosure of which is incorporated by reference herein in its entirety. Suspension assembly (20) includes one or more springs (21). A variety of springs (21) are envisioned including coil springs (not shown). Other suspension assemblies (20) are also envisioned. Adaptation of suspension assembly (20) allows for a single configuration adaptable to various furniture configurations as described above including but not limited to an ottoman, an armless chair, an armchair, a loveseat, a sofa, a sofa with a chaise, and a sectional.

For example, three separate suspension assemblies (20) may be used for a three-seat sofa. Two separate suspension assemblies (20) may be used for a loveseat. A single suspension assembly (20) may be used for a chair. Different suspension parameters may allow for user customization based on the estimated weight of users and/or the desired seat firmness (e.g., hard, soft, intermediate). Additionally, a piece such as an ottoman may have different parameters than a chair usable by a large person for sitting.

2. Snap Fit Anchor Bracket

Figure 3:
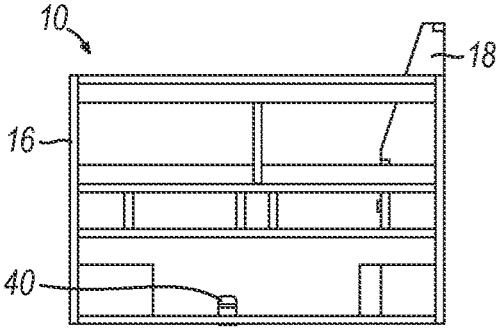
FIG. 3 depicts a left side elevational view of the modular furniture assembly of FIG. 2.
Figure 4:
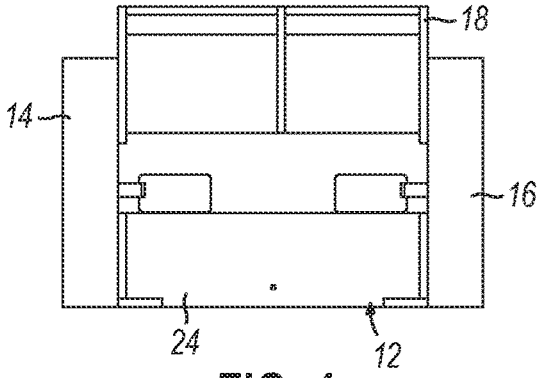
FIG. 4 depicts a front elevational view of the modular furniture assembly of FIG. 2.
Figure 1:
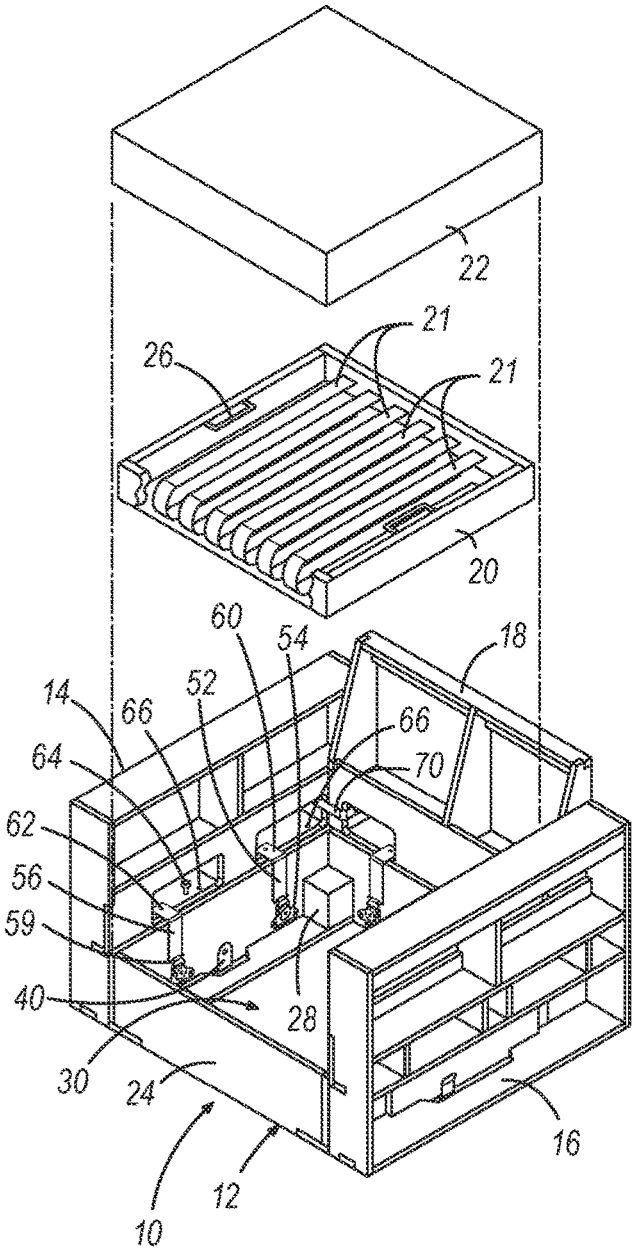
FIG. 1 depicts an exploded perspective view of a first modular furniture assembly that includes a base, a back, first and second arms, a plurality of exemplary brackets, a suspension assembly, and a bottom cushion, with the bottom cushion spaced from the suspension assembly which is spaced from the base.
Figure 6:
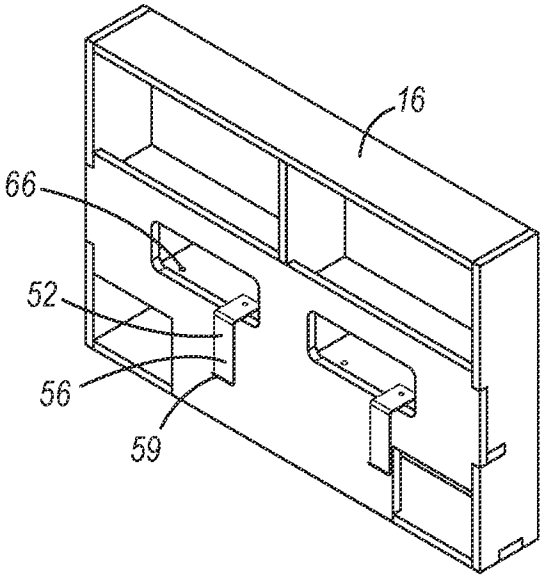
FIG. 6 depicts a perspective view of the second arm and brackets of FIG. 1.
Figure 7:
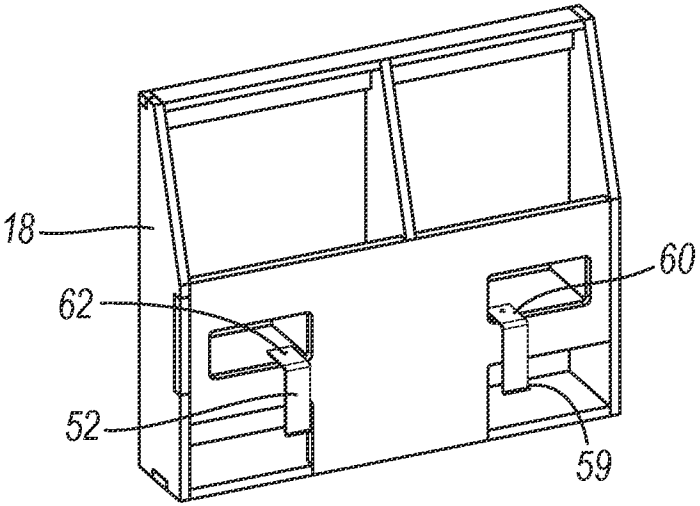
FIG. 7 depicts a perspective view of the back and brackets of FIG. 1.
Figure 5:
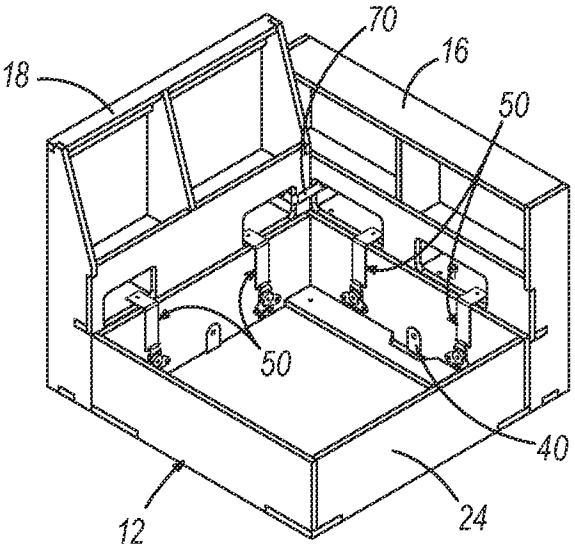
FIG. 5 depicts a perspective view of the base, the back, and the second arm of FIG. 1 connected together using brackets.
Figure 10:
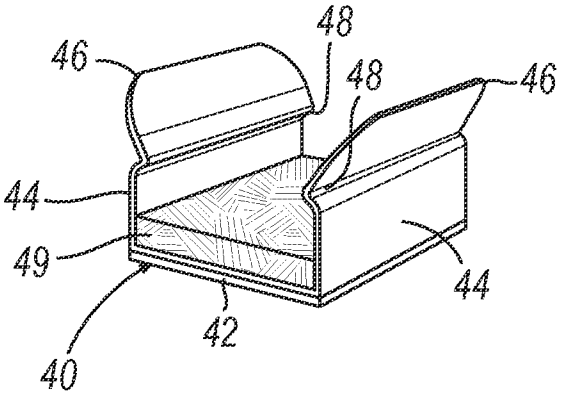
FIG. 10 depicts a perspective view of an exemplary alternative bracket.

FIG. 10 shows an exemplary removable bracket (40), which may also be referred to as a snap fit anchor bracket, may connect the bottom of two adjoining pieces of furniture (e.g., base (12), arms (14, 16), back (18) or combinations such as two or more bases (12)). Removable bracket (40) may be placed into the bottom of a base (12) as shown in FIGS. 1, 3, and 5. Removable bracket (40) may include a snap fit connection, so that the user may be audibly alerted when the component pieces are suitably secured together.

Removable bracket (40), which may also be referred to an anchor foot, includes a bottom web (42) and flanges (44) which extend from web (42). Flanges (44) terminate in tips (46) which may be formed to have bevels (48) that urge components together. Pad (49) may be a resilient member that bears the weight of the assembly (10). Removable bracket (40) may connect a furniture back (18) to base (12), arm (14, 16) to seat base (12), an armless chair to an armchair, and an ottoman to an armchair. Removable bracket (40) provides support at the bottom of frame (24) and the equivalent structures in arms (14, 16) and back (18) to mitigate side to side racking of connected components. Removable bracket (40) has a flexible nature using bevels (48) and the resilience of web (42) and flanges (44) allow for straightforward installation and removal.

3. Docking Bracket

Figure 9:
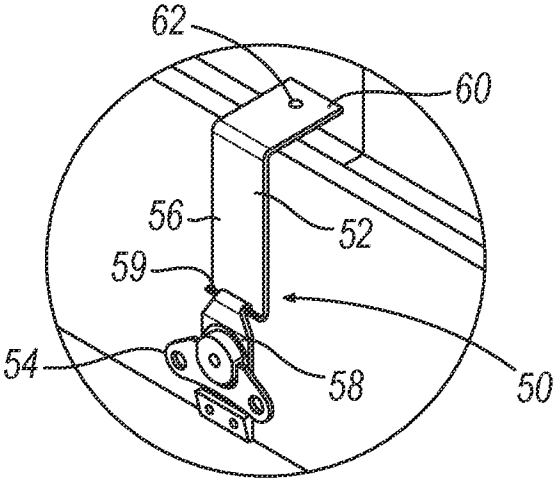
FIG. 9 depicts an enlarged perspective view of another bracket of FIG. 1.

FIG. 9 shows a connection assembly (50) that allows for backs (18) and arms (14, 16) to connect to a seat frame (24) with a combination of a bracket (52) and latch (54). Connection assembly (50) uses a fixed sliding L-shaped bracket (52) to mount to arm (14, 16) or back (18). This fixed L-shaped bracket (52) includes a downwardly extending leg (56) configured to engage latch (54) with toggle (58) causing engagement or disengagement to lock the components together or release them. Leg (56) of bracket (52) may have a lip (59) to specifically engage toggle latch (54). Horizontal leg (60) may be fitted with a mounting aperture (62) that is itself adapted to receive a threaded fastener (64) (see FIG. 1). Threaded fastener (64) may include a screw, bolt, or a thumb screw to permit manual assembly or disassembly without the use of tools. In some versions, fastener (64) may engage recessed portion (66) that may be a T-nut or other embedded, internally threaded receptacle.

4. Connection Bracket

FIGS. 1 and 5 show exemplary brackets (70), which may also be referred to as connection brackets. Brackets (70) may be used to connect respective arms (14, 16) to back (18), and back (18) to an adjacent back (18). Brackets (70) secure two components together and mitigate gaps at the ends of backs (18) of the two connected pieces. Brackets (70) may incorporate thumb screws, such as threaded fastener (64) (see FIG. 1), on both ends and may fasten into a T-nut such as the recessed portion (66) described above located on a furniture component. Alternatively, a configuration such as L-shaped bracket (52) may be used.

Figure 12:
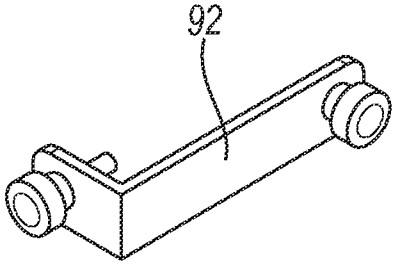
FIG. 12 depicts a perspective view of another exemplary alternative bracket.
Figure 11:
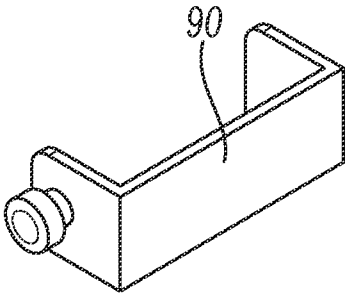
FIG. 11 depicts a perspective view of another exemplary alternative bracket.
Figure 8:
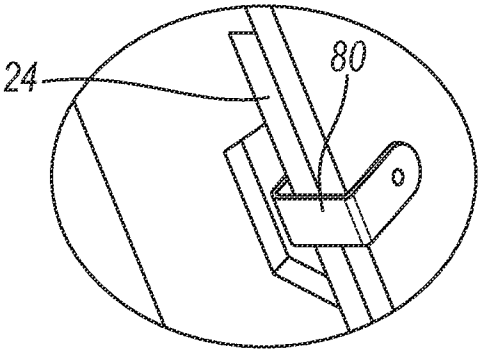
FIG. 8 depicts an enlarged perspective view of a bracket of FIG. 1.

Alternative exemplary brackets include a fixed anchor bracket (80) (see FIG. 8), a C-shaped side to side bracket (90) (see FIG. 11), and an L-shaped arm to side bracket (92), FIG. 12. Brackets (80) may connect backs (18), such as in a sofa or loveseat configuration. Brackets (90) may connect arms (14, 16) to backs (18).

Bracket (52) and fastener (64) are disposed at least partially within recessed portion (66) and may provide a direct mechanical connection between rigid frame members such as frame (24) and the structural frames of first and second arms (14, 16) and back (18). Base (12), first and second arms (14, 16), and back (18) may be upholstered. The fixed mount, even in an edge of a member of the frame (24) may provide an improved connection. Different locations for recessed portions (66) may provide customization for factors like different upholstery thicknesses. By comparison, snap fit anchor foot bracket (40) is at the bottom, thus the weight of modular furniture assembly (10) may assist in urging compression and improve the likelihood that components (12, 14, 16, 18) to remain in alignment when bearing weight.

B. Second Exemplary Modular Furniture Assembly

Figure 13:
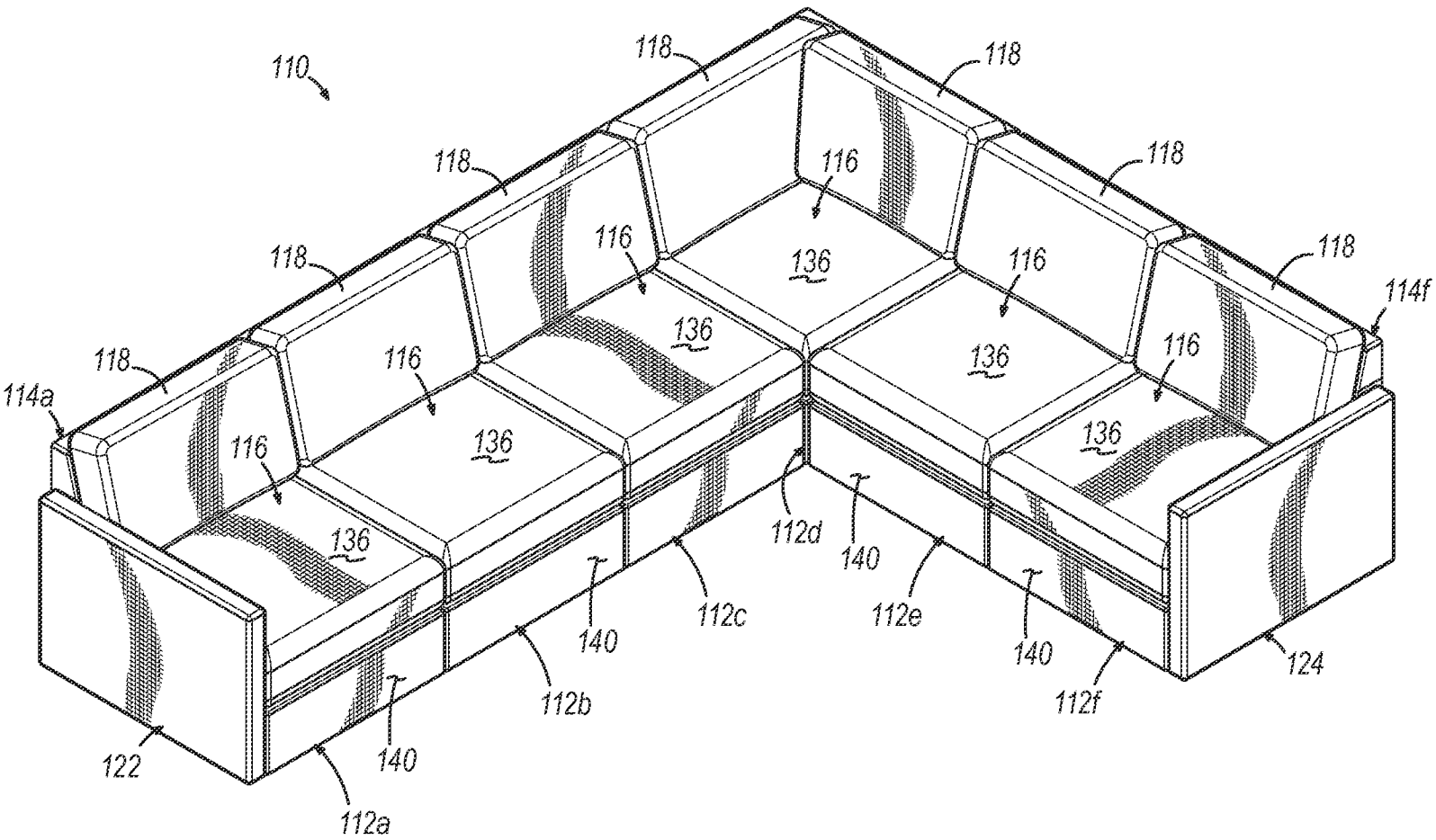
FIG. 13 depicts a perspective view of a second modular furniture assembly.

FIGS. 13-19 show a second modular furniture assembly (110) in the form of a sectional. Particularly, modular furniture assembly (110) is in the form of an L-shaped sectional. FIG. 13 shows modular furniture assembly (110) in a fully assembled state. As shown, modular furniture assembly (110) includes a plurality of bases (112*a-f*), a plurality of backs (114*a-f*), a plurality of removable seats (116), a plurality of back cushions (118), a corner section (120), a first arm (122), and a second arm (124). Modular furniture assembly (110) may be reconfigured into a variety of different arrangements as desired by a user using the same number of components or different number of components. For example, modular furniture assembly (110) may be converted into an armchair, an armless chair, a corner chair, a chaise lounge, a bench, an ottoman, a playpen, as well as many other arrangements.

Figure 14:
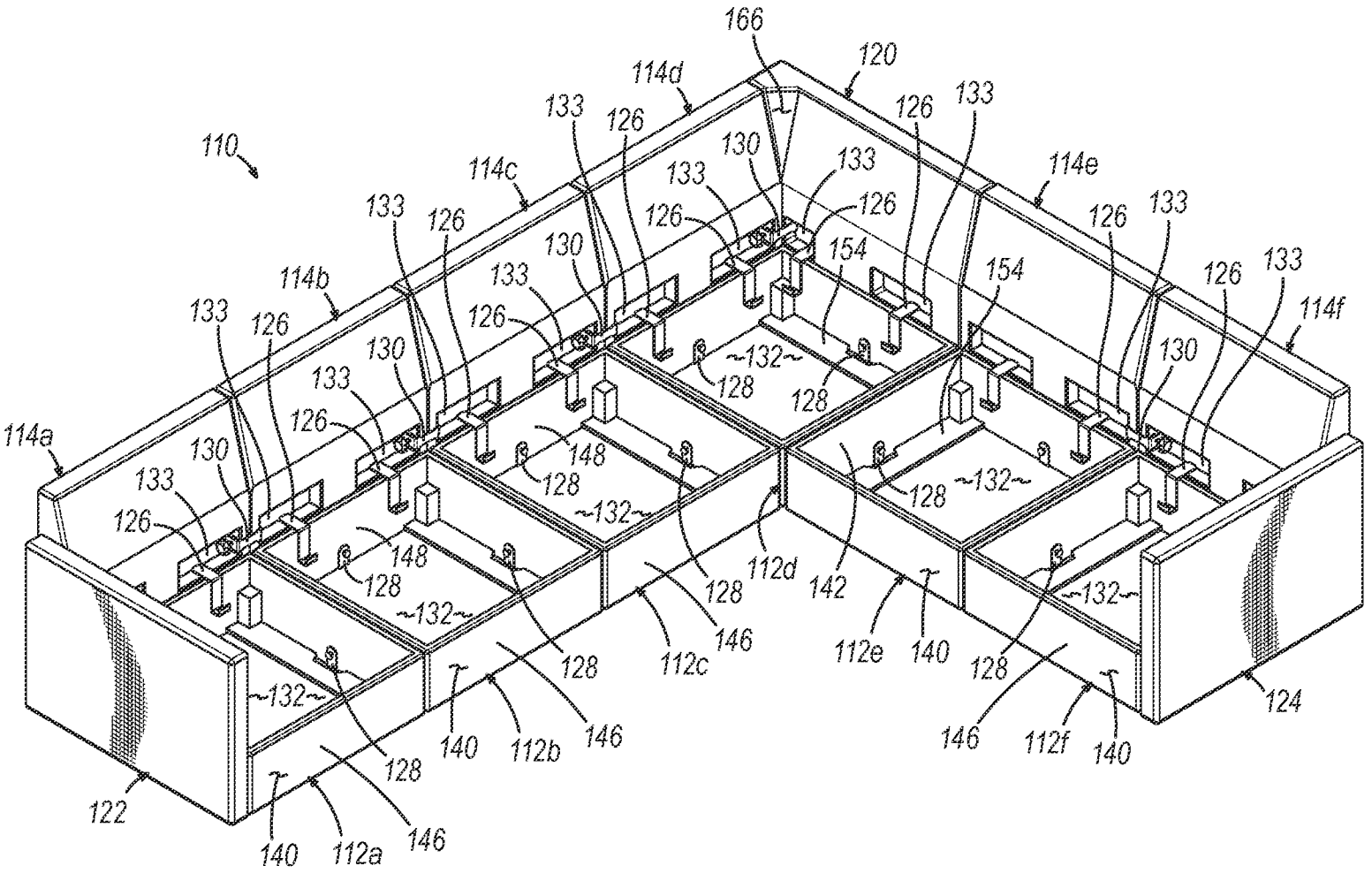
FIG. 14 depicts a perspective view of the modular furniture assembly of FIG. 13, but with the suspension assemblies, bottom cushions, and back cushions removed to reveal brackets and cavities of bases.
Figure 15:
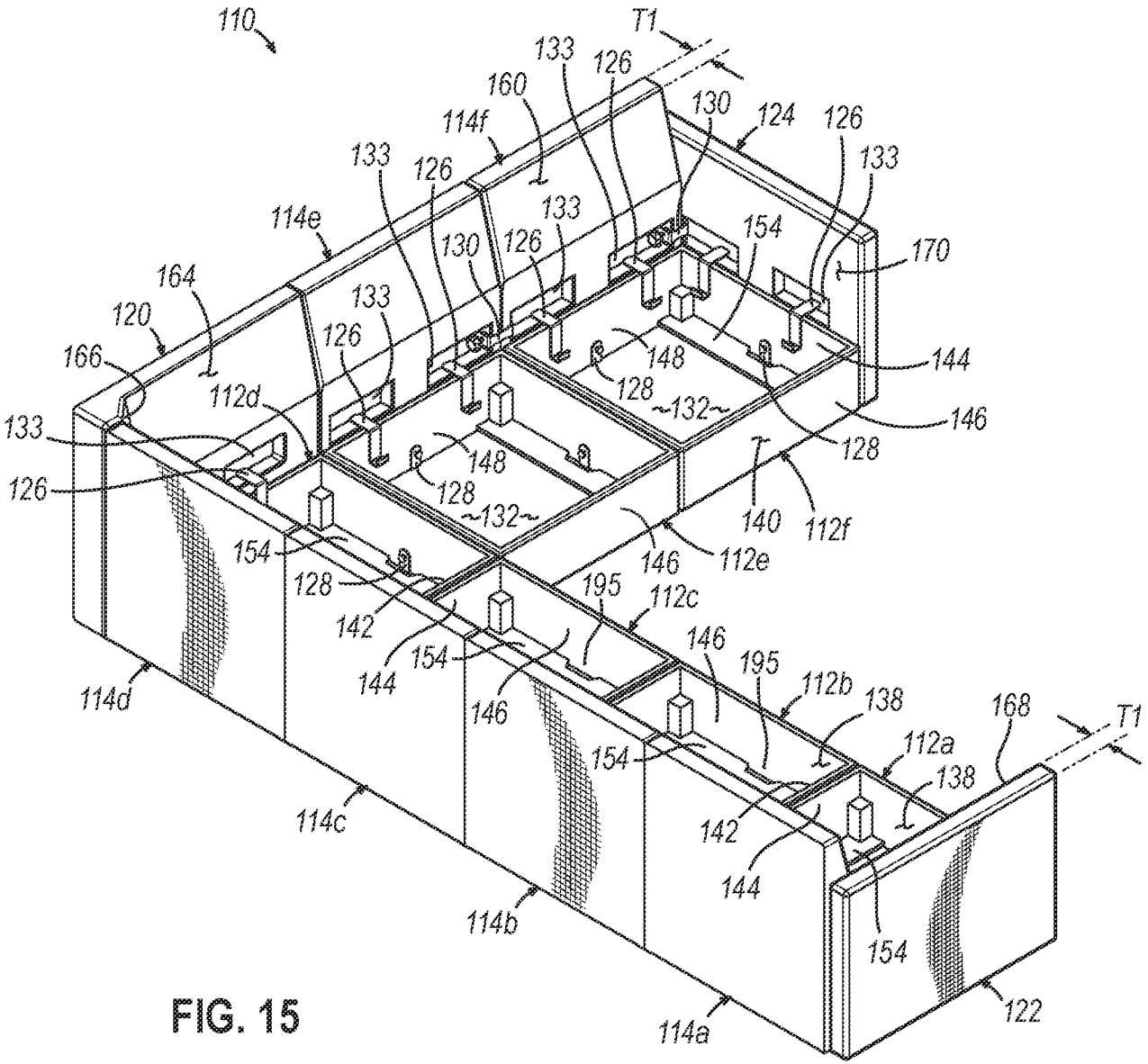
FIG. 15 depicts another perspective view of the modular furniture assembly of FIG. 14.

FIGS. 14-15 show modular furniture assembly (110) of FIG. 13, but with removable seats (116) and back cushions (118) removed to reveal brackets (126, 128, 130) and cavities (132) within bases (112*a-f*). The particular structures of brackets (126, 128, 130) will be described below with reference to FIGS. 18-19. It is envisioned that multiple brackets (126) between components may be replaced with single brackets (126) to achieve the same or similar function. For example, a single bracket (126) may connect respective bases (112*a-f*) and backs (214*a-f*). Conversely, the use of single brackets (128, 130) between components may be replaced with multiple brackets (128, 130) to achieve the same or similar function. Additionally, the arrangement of brackets (126, 128, 130) varies based on the particular arrangement of modular furniture assembly (110). Respective brackets (126, 128, 130) are spaced a distance from each other. In some versions, brackets (128) may be used instead of brackets (130), while in other versions, brackets (130) may be used instead of brackets (128). Using two types of brackets (two of brackets (126, 128, 130)), instead of three types of brackets (each of brackets (126, 128, 130)) may simplify the assembly and disassembly process for a user. While brackets (126, 128, 130) are described and shown, other brackets having different structures may also be incorporated.

Base (112*a*) may be connected with first arm (122) using two brackets (126) and one bracket (128). Additionally, base (112*a*) is connected with back (114*a*) using two brackets (126) and one bracket (128). Base (112*a*) is connected with base (112*b*) using one bracket (128). Base (112*b*) is connected with back (114*b*) using two brackets (126) and one bracket (128). Base (112*b*) is connected with base (112*c*) using one bracket (128). Base (112*c*) is connected with back (114*c*) using two brackets (126) and one bracket (128). Base (112*c*) is connected with base (112*d*) using one bracket (128). Base (112*d*) is connected with back (114*d*) using two brackets (126) and one bracket (128). Additionally, base (112*d*) is connected with corner section (120) using two brackets (126) and one bracket (128). Similarly, base (112*d*) is connected with base (112*e*) using one bracket (128). Base (112*e*) is connected with back (114*e*) using two brackets (126) and one bracket (128). Base (112*e*) is connected with base (112*f*) using one bracket (128). Base (112*f*) is connected with back (114*f*) using two brackets (126) and one bracket (128). Additionally, base (112*f*) is connected with second arm (124) using two brackets (126) and one bracket (128).

Backs (114*a-f*), corner section (120), first arm (122), and second arm (124) are each shown as including two recessed portions (133); however, more or fewer recessed portions (133) are also envisioned. Recessed portions (133) are configured to receive at least a portion of brackets (126, 130). As shown in FIG. 15, two brackets (126) are configured to connect second arm (124) with base (112*f*) and also simultaneously support removable seat (116) within cavity (132) of base (112*f*). Similarly, two brackets (126) are configured to connect first arm (122) with base (112*a*) and also simultaneously support removable seat (116) within cavity (132) of base (112*a*).

Regarding brackets (130), first arm (122) may be connected with back (114*a*) using one bracket (130). Back (114*a*) is connected with back (114*b*) using one bracket (130). Similarly, back (114*b*) is connected with back (114*c*) using one bracket (130), and back (114*c*) is connected with back (114*d*) using one bracket (130). Back (114*d*) is connected with corner section (120) using one bracket (130). Back (114*c*) is connected with back (114*d*) using one bracket (130). Back (114*e*) is connected with back (114*f*) using one bracket (130). Second arm (124) is connected with back (114*f*) using one bracket (130). However, once again, more or fewer brackets (126, 128, 130) are also envisioned. For example, it is envisioned that back (114*a*) may not be connected with back (114*b*). Similarly, it is envisioned that back (114*b*) may not connected with back (114*c*), and back (114*e*) may not be connected with back (114*f*).

Each removable seat (116) includes a suspension assembly (134) (see FIGS. 16-17) and a bottom cushion (136). Suspension assembly (134) may be similar to suspension assembly (20) and is removable from bases (112*a-f*). For example, suspension assembly (134) is able to accommodate different suspension types, preferable leaf spring or combined springs, such as those described in U.S. Pat. No. 9,103,397, entitled "Double Spring Function Upholstered Furniture Spring Assemblies," issued Aug. 11, 2015, the disclosure of which is incorporated by reference herein in its entirety. Suspension assembly (134) includes at least one handle (135), so that suspension assembly (134) may be easily set into the respective base (112*a-f*). Suspension assembly (134) may be dropped into (i.e., set into) and removed from base (112*a-f*). Suspension assemblies (134) may be same or different for each base (112*a-f*). Suspension assembly (134) supports bottom cushion (136). Bottom cushion (136) is configured to support a user (not shown) thereon. In some versions, removable seat (116) may combine suspension assembly (134) with bottom cushion (136) into a single component.

Figure 16:
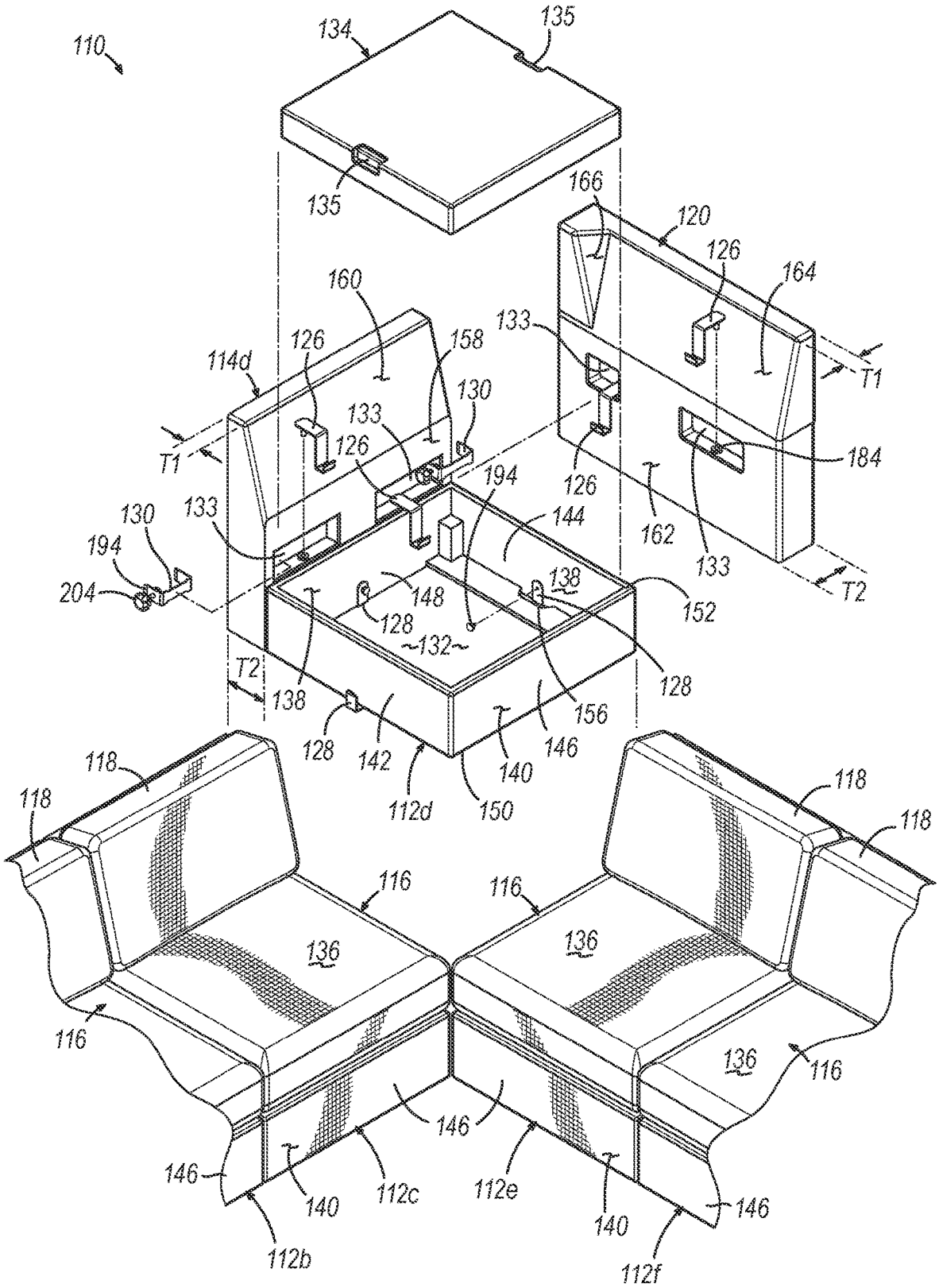
FIG. 16 depicts a partially exploded perspective view of an enlarged portion of FIG. 13.
Figure 17:
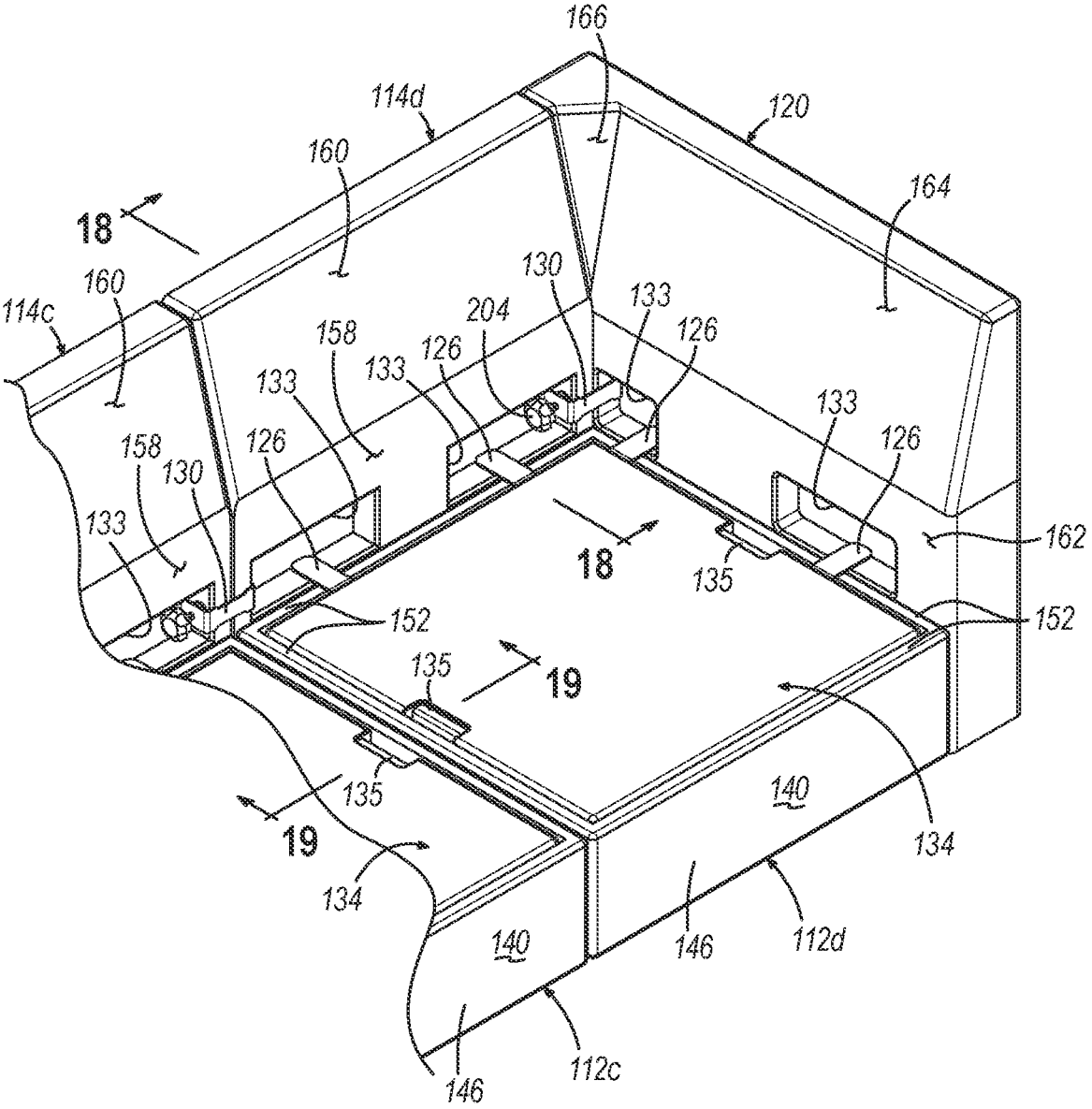
FIG. 17 depicts a perspective view of an enlarged portion of FIG. 16.

FIGS. 16-17 describe the structure of bases (112*a-f*) with particular reference to the connecting of base (112*d*) with back (114*d*) and corner section (120). While the connecting of base (112*d*), back (114*d*), and corner section (120) are shown, this also applies to the connecting of bases (112*a-c*, 112*e-f*), backs (114*a-c*, 114*e-f*), first and second arms (122, 124) as described above. Base (112*d*) is interposed between corner section (120) and base (112*c*). Base (112*d*) is also interposed between base (112*e*) and back (114*d*). While the structure of base (112*d*) is described, this also applies to bases (112*a-b, d-f*). As shown in FIG. 16, base (112*d*) includes inner and outer surfaces (138, 140). Inner surface (138) defines cavity (132). At least an outer surface (140) may be wrapped in padding and/or fabric which may be removable or non-removable from bases (112*a-f*). Base (112*d*) includes a first lateral wall (142), a second lateral wall (144) disposed opposite first lateral wall (142), a front wall (146), a rear wall (148) disposed opposite front wall (146), a bottom surface (150), and a top surface (152) disposed opposite bottom surface (150). Bases (112*a-f*) are shown as including cross-members (154) with cutouts (156) that define handles.

Backs (114*a-f*) each include an inner facing surface (158) and a tapered surface (160), with backs (114*c-d*) being shown in FIG. 17. Tapered surface (160) is angled away from inner facing surface (158). Tapered surfaces (160) of backs (114*a-f*) are angled in a direction away from respective bases (112*a-f*). Corner section (120) includes an inner facing surface (162), a first tapered surface (164), and a second tapered surface (166). As shown in FIG. 17, first tapered surface (164) is angled away in a first direction from inner facing surface (162) and base (112*d*). Second tapered surface (166) is angled from away tapered surfaces (160, 164) in a second direction. First arm (122) includes an inner facing surface (168). Similarly, second arm (124) includes an inner facing surface (170). Inner facing surfaces (158, 162, 168, 170) are each shown as being planar and extending vertically. Tapered surfaces (160, 164, 166) are each shown as being planar; however, a variety of surfaces are also envisioned. First and second arms (122, 124) and an upper portion of backs (114*a-f*) have a first thickness (T1). A lower portion of backs (114*a-f*) and a lower portion of corner section (120) have a second thickness (T2) that is greater than first thickness (T1).

Four brackets (126) are shown in FIG. 16 as being configured to secure inner surface (138) of base (112*d*) against back (114*d*) and inner surface (138) of base (112*d*) against corner section (120); however, more or fewer brackets (126) are envisioned. Three brackets (128) are shown in FIG. 16 as being secured to inner surface (138) of base (112*d*); however, more or fewer brackets (128) are envisioned. Two brackets (130) are shown in FIG. 16, with one bracket being configured to secure back (114*c*) with back (114*d*) and another bracket (130) being configured to secure back (114*d*) with corner section (120); however, more or fewer brackets (130) are envisioned.

Figure 18:
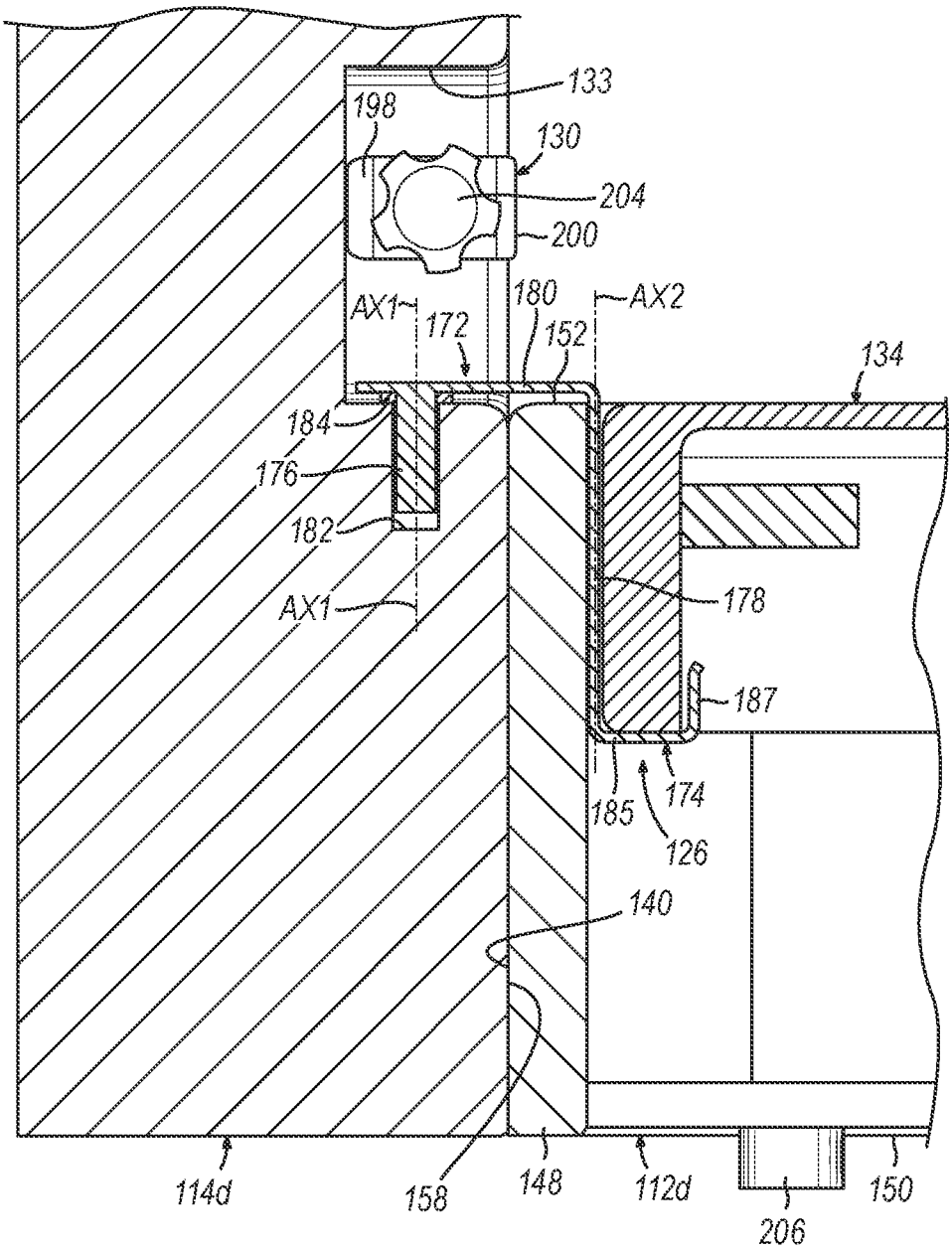
FIG. 18 depicts a cross-sectional view of a portion of the modular furniture assembly of FIG. 17 taken along line 18-18 of FIG. 17.

FIG. 18 shows a cross-sectional view of a portion of modular furniture assembly (110) of FIG. 17 taken along line 18-18 of FIG. 17 to illustrate brackets (126, 130). Bracket (126) includes first and second portions (172, 174). First portion (172) is configured to connect back (114*d*) to base (112*d*). As shown in FIG. 17, additional brackets (126) include first portions (172) configured to connect corner section (120) with base (112*e*). As shown, first portion (172) includes a projection (176), an intermediate portion (178), and a connecting portion (180). Projection (176) extends along a first axis (AX1). Projection (176) is shown as a cylindrical pin. Intermediate portion (178) extends along a second axis (AX2) that is parallel to and offset from first axis (AX1). Connecting portion (180) joins projection (176) with intermediate portion (178). Bracket (126) is configured to connect one of back (114*a-f*), first arm (122), second arm (124), or corner section (120) over top surface (152) of base (112*a-f*). Backs (114*a-f*), first arm (122), second arm (124), and corner section (120) each include a slot (182) configured to receive projection (176). As shown, slots (182) are disposed within recessed portions (133). As shown, an optional insert (184) is inserted into slot (182) to receive projection (176). As shown, bracket (126) generally has a S-shape. Bracket (126), including first and second portions (172, 174), is integrally formed together as a unitary piece.

As shown in FIGS. 16 and 18, projection (176), intermediate portion (178), and connecting portion (180) are configured to force outer surface (140) of base (112*d*) against inner facing surface (158) of back (114*d*). Similarly, referring to FIGS. 16-17, projection (176), intermediate portion (178), and connecting portion (180) are configured to force outer surface (140) of base (112*d*) against inner facing surface (162) of corner section (120). Similarly, referring to FIGS. 14-15, projection (176), intermediate portion (178), and connecting portion (180) are configured to force outer surface (140) of base (112*a*) against inner facing surface (168) of first arm (122). Likewise, projection (176), intermediate portion (178), and connecting portion (180) are configured to force outer surface (140) of base (112*f*) against inner facing surface (170) of second arm (124).

Second portion (174) of bracket (126) is configured to support removable seat (116). As shown, second portion (174) is in tension to support removable seat (116). Suspension assembly (134) is configured to contact second portion (174). Second portion (174) includes a supporting portion (185) and a retaining portion (187). Supporting portion (185) is configured to support suspension assembly (134) within cavities (132) of bases (112*a-f*). Retaining portion (187) extends generally perpendicular to supporting portion (185) and is configured to retain suspension assembly (134) within supporting portion (185).

As generally shown in FIG. 15, bracket (128) is configured to connect to second arm (124) under bottom surface (150) of base (112*f*) to inner surface (138) of base (112*f*). While not shown, similarly, one or more brackets (128) are configured to connect to first arm (122) under bottom surface (150) of base (112*a*) to inner surface (138) of base (112*a*).

Figure 19:
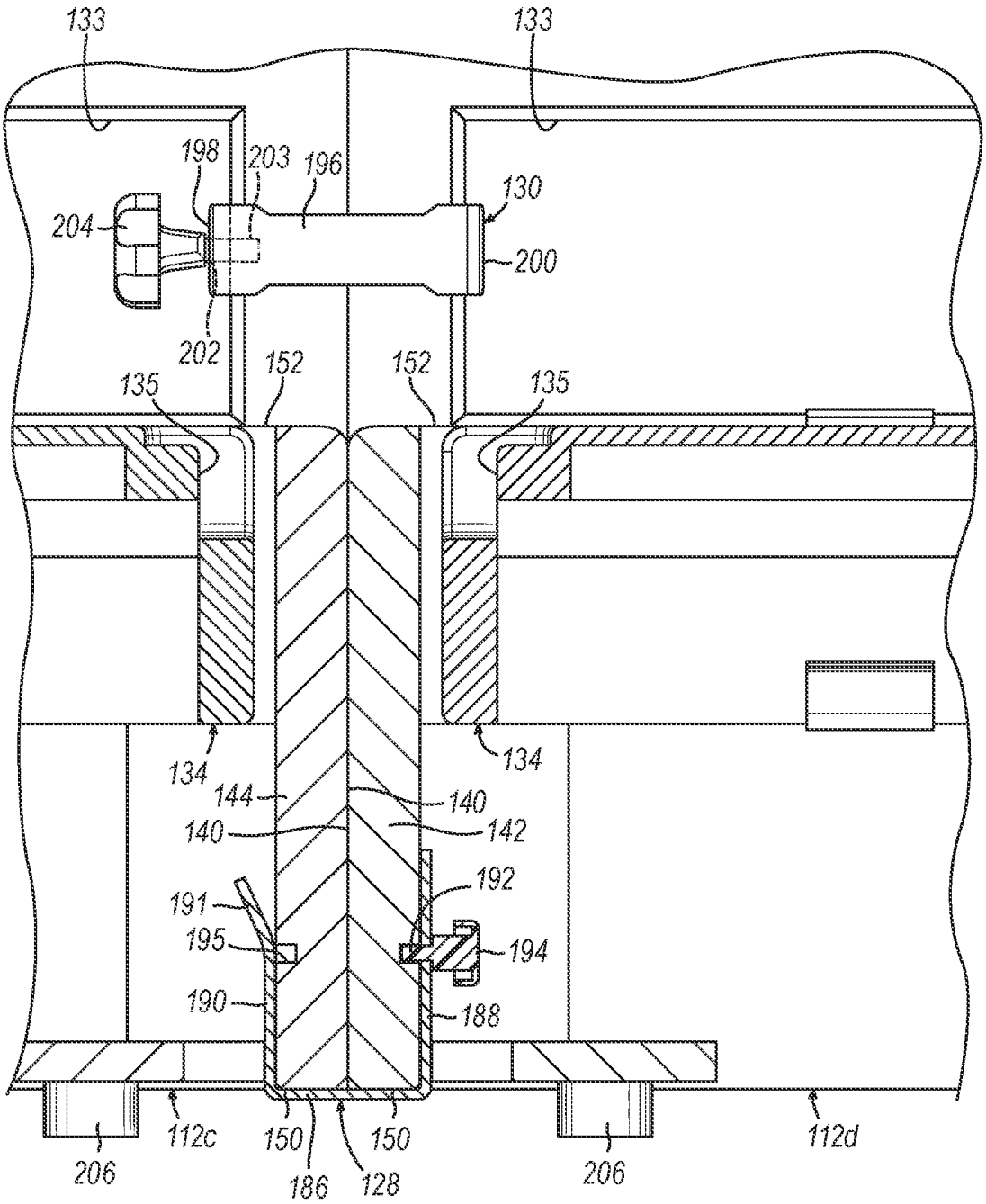
FIG. 19 depicts a cross-sectional view of a portion of the modular furniture assembly of FIG. 17 taken along line 19-19 of FIG. 17.

FIG. 19 shows a cross-sectional view of a portion of modular furniture assembly (110) taken along line 19-19 of FIG. 17 to illustrate brackets (128, 130). As shown in FIG. 19, bracket (128) includes a base (186), a first leg (188), and a second leg (190). First and second legs (188, 190) extend generally perpendicular to base (186). However, second leg (190) is shown as including an outwardly extending tip (191). First leg (188) includes a threaded aperture (192) configured to receive a threaded fastener (194) therethrough. Inner surface (138) of bases (112*a-f*) are shown as including apertures (195), which may be threaded or non-threaded to receive threaded fastener (194). Threaded fastener (194) is configured to adjustably secure bracket (128) against inner surface (138) of base (112*c*). In some versions, a threaded fastener (similar to threaded fastener (194)) may extend through second leg (190) similar to threaded fastener (194) extending through first leg (188). As shown in FIG. 19, bracket (130) includes a base (196), a first leg (198), and a second leg (200). First and second legs (198, 200) extend generally perpendicular to base (196). First leg (198) includes a threaded aperture (202) configured to receive a threaded fastener (204). As shown in FIGS. 18 and 19, feet (206) of modular furniture assembly (110) are configured to directly contact a support surface (e.g., hardwood, carpet, tile, etc.). In some versions, threaded fastener (204) may be received within a threaded aperture (203) of recessed portions (133). Threaded aperture (203) may provide additional rigidity and support between adjacent components. Alternatively, aperture (203) may be non-threaded.

C. Third Exemplary Modular Furniture Assembly and Associated Method of Assembly

FIGS. 20A-20E shows a third exemplary modular furniture assembly (210). Components of modular furniture assembly (210) may be the same or similar to (and may function the same or similarly to) those components of the same name of modular furniture assembly (10) described in detail above with reference to FIGS. 1-12 and/or modular furniture assembly (110) described in detail above with reference to FIGS. 13-19, except as where otherwise described below.

As shown in FIGS. 20A-20E and as similar to modular furniture assembly (110), modular furniture assembly (210) includes a base (212), a back (214), a removable seat (216), a back cushion (218), a first arm (222), a second arm (224), one or more brackets (226), one or more brackets (228), one or more brackets (230). In some versions, brackets (228) may be used instead of brackets (230), while in other versions, brackets (230) may be used instead of brackets (228). First arm (222), second arm (224), and back (214) each include recessed portions (233), slots (282), and inserts (284). Similar to base (112*a-f*), base (212) includes a cavity (232), an inner surface (238), an outer surface (240), a first lateral wall (242), a second lateral wall (244), a front wall (246), a rear wall (248), a bottom surface (250), a top surface (252), a cross-member (254), cutouts (256), and apertures (295). Back (214) includes an inner facing surface (258) and a tapered surface (260). Removable seat (216) includes a suspension assembly (234), handles (235), and a bottom cushion (236). First arm (222) includes an inner facing surface (268). Similarly, second arm (224) includes an inner facing surface (270).

Similar to bracket (126), bracket (226) includes a first portion (272) and a second portion (274). First portion (272) includes a projection (276), an intermediate portion (278), and a connecting portion (280). Second portion (274) includes a supporting portion (285) and a retaining portion (287). Similar to bracket (128), bracket (228) includes a base (286), a first leg (288), a second leg (290), an outwardly extending tip (291), a threaded aperture (292), and a fastener (294). Similar to bracket (130), bracket (230) includes a base (296), a first leg (298), a second leg (300), and a threaded aperture (302). In some versions, a threaded fastener (304) may be received within an aperture (303) of recessed portions (233). Aperture (303) may include internal threads. Aperture (303) may provide additional rigidity and support between adjacent components.

Unlike modular furniture assembly (110) described in detail above, modular furniture assembly (210) is in the form of a chair similar to modular furniture assembly (10). Additionally, first and second arms (222, 224) are different than first and second arms (122, 124) described above. Particularly, first and second arms (222, 224) are shown as having a different thickness that is more similar in thickness to arms (14, 16) shown in FIGS. 1, 2, and 4-6.

FIGS. 20A-20F show an exemplary method of assembling modular furniture assembly (210). This method is generally similar to that of the assembly of modular furniture assembly (110), but modular furniture assembly (110) has additional components connected together using additional brackets (126, 128, 130) as shown in FIGS. 14-15. For example, whereas modular furniture assembly (110) is shown as including six bases (112*a-f*), six backs (114*a-f*), one corner section (120), and two arms (122, 124), modular furniture assembly (210) is shown as including one base (212), one back (214), and two arms (222, 224). However, more or fewer components for each modular furniture assembly (10, 110, 210) is envisioned.

Figure 20A:
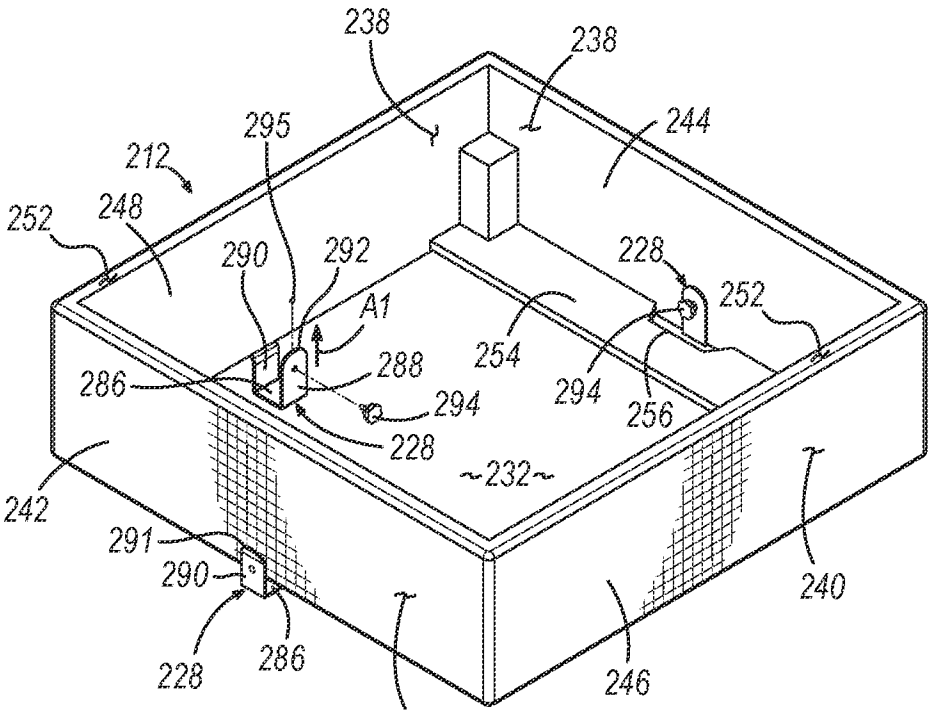
FIG. 20A depicts a perspective view of an exemplary bracket being connected with a base of a third exemplary modular furniture assembly.

FIG. 20A shows one exemplary bracket (228) being actively connected with base (212). Particularly, bracket (228) is inserted upwards as shown by arrow (A1), so that an inner surface of base (286) of bracket (228) contacts bottom surface (250) of base (212). A fastener (294) is inserted through threaded aperture (292) of first leg (288) to fixably secure bracket (228) with inner surface (238) of rear wall (248) of base (212). In a similar manner, another bracket (228) is shown as being already connected with inner surface (238) of first lateral wall (242). Similarly, another bracket (228) is shown as being already connected with inner surface (238) of second lateral wall (244). A gap exists between each second leg (290) of bracket (228) and the respective outer surface (240) of base (212). This gap is configured to receive another base (not shown), back (214), first arm (222) or second arm (224) as described below.

Figure 20B:
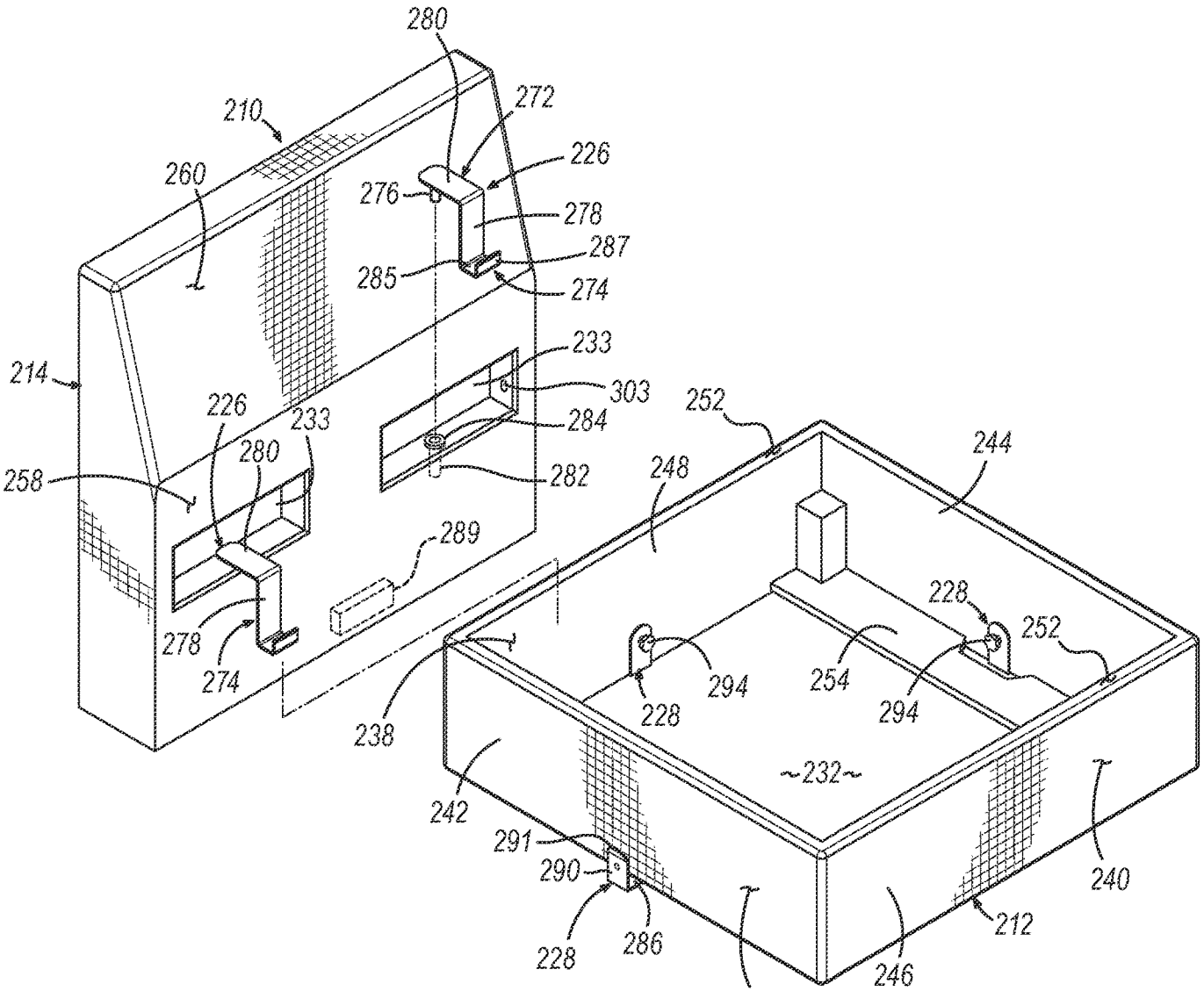
FIG. 20B depicts a perspective view of a back being connected with the base of FIG. 20A using another exemplary bracket.

FIG. 20B shows back (214) being actively connected with base (212) of FIG. 20A. Projections (276) of first portion (272) of bracket (226) may be inserted into slots (282) of back (214) so that a gap exists between intermediate portion (278) of bracket (226) and back (214). Another bracket (226) is shown as being already inserted into slot (282) and insert (284). A portion of base (212) may be inserted into a gap defined between inner facing surface (258) of back (214) and intermediate portion (278) of bracket (226) to force base (212) against back (214). As shown, back (214) is lifted upward so that intermediate portion (278) of bracket (226) contacts inner surface (238) of rear wall (248) to retain inner surface (238) within the gap.

Similar to the cross-section of FIG. 18 (regarding bracket (126), base (112*d*), and back (114*d*)), projection (276), intermediate portion (278), and connecting portion (280) are configured to force outer surface (240) of base (212) against inner facing surface (258) of back (214). Additionally, second leg (290) of bracket (228) pushes inner facing surface (258) of back (214) against outer surface (240) of rear wall (248). In other words, outer surface (240) of rear wall (248) is in direct contact with inner facing surface (258) of back (214). In some versions, brackets (226, 228) may compress padding and/or fabric of base (212) and back (214) during this connecting. Second leg (290) may be received within a slot (289) (shown schematically in dashed lines) of back (214). In some versions, slot may extend vertically.

Figure 20C:
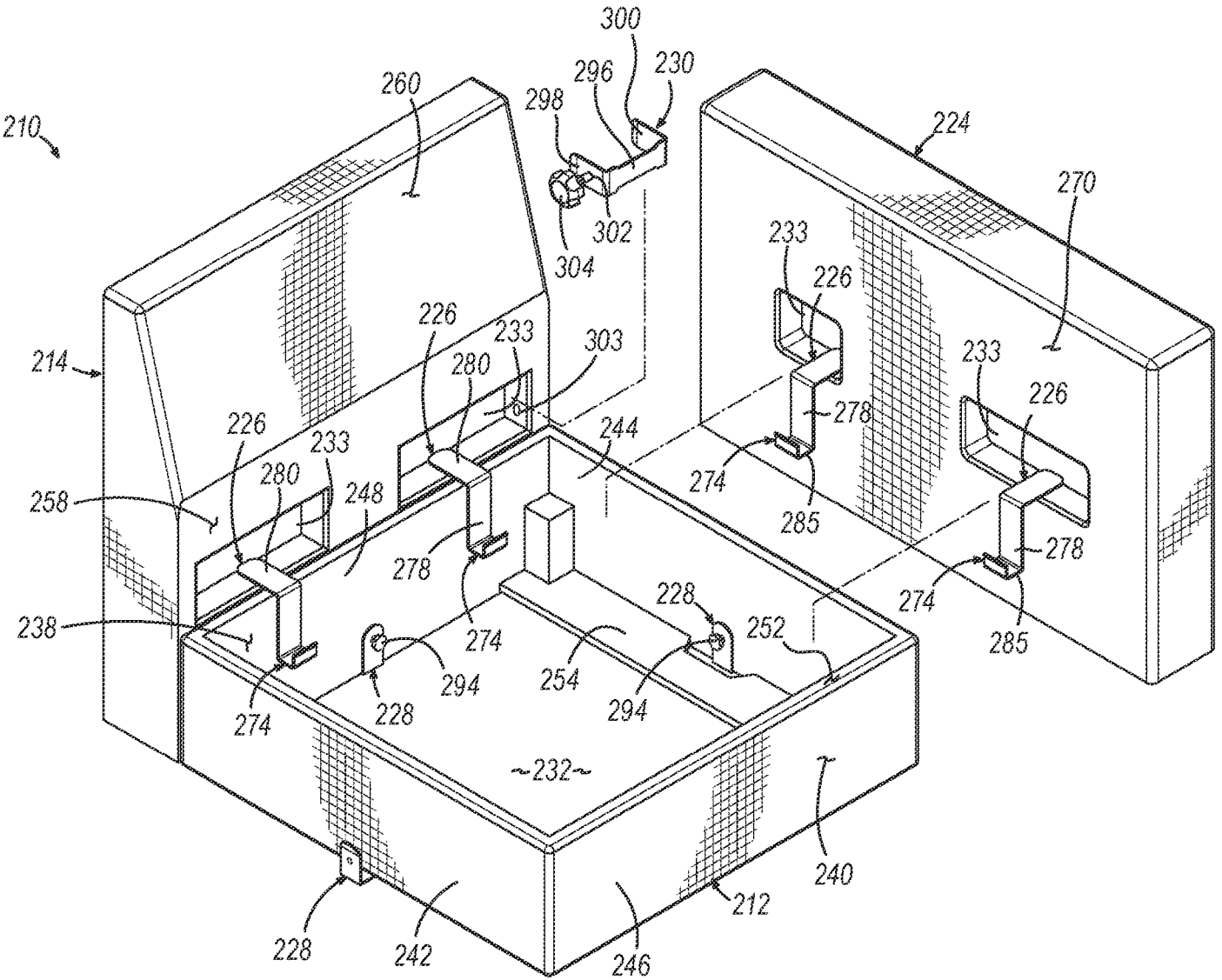
FIG. 20C depicts a perspective view of the back connected with the base of FIG. 20B and a second arm being connected with the base using brackets of FIG. 20B.
Figure 20D:
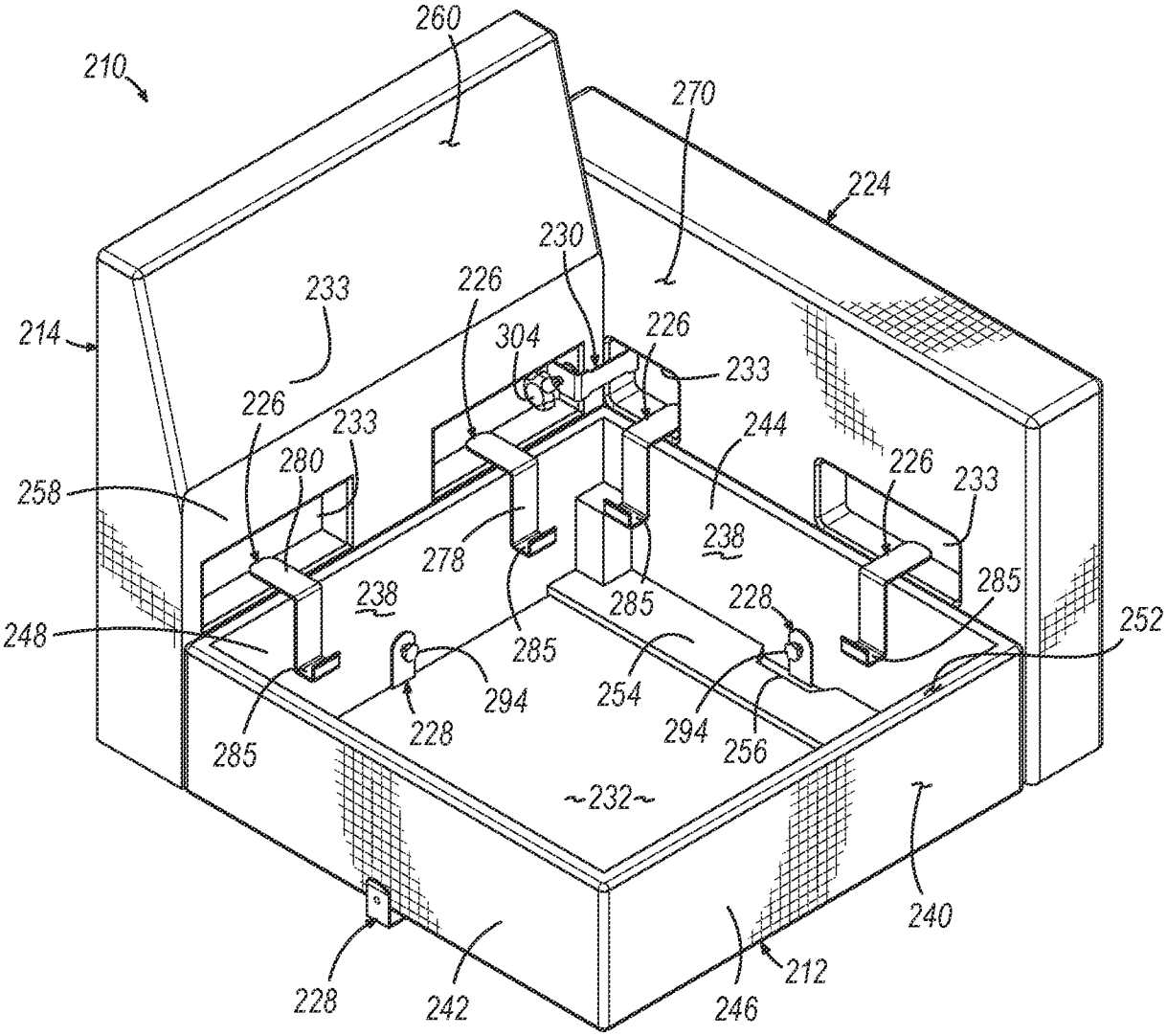
FIG. 20D depicts a perspective view of the base, the back, and the second arm connected together using the brackets of FIG. 20C.

FIG. 20C shows back (214) connected with base (212) of FIG. 20B, while also showing second arm (224) being actively connected with base (212) using brackets (226, 228, 230) of FIG. 20B. A portion of base (212) is shown being inserted into a gap defined between inner facing surface (270) of second arm (224) and intermediate portion (278) of bracket (226) to force base (212) against second arm (224). As shown, second arm (224) is lifted upward so that intermediate portion (278) of bracket (226) contacts inner facing surface (270) of second arm (224) to retain inner surface (238) within the gap. Projection (276), intermediate portion (278), and connecting portion (280) are configured to force outer surface (240) of base (212) against inner facing surface (270) of second arm (224). Additionally, second leg (290) of bracket (228) pushes inner facing surface (270) against outer surface (240) of second lateral wall (244). In other words, outer surface (240) of second lateral wall (244) is in direct contact with inner facing surface (270) of second arm (224). Bracket (230) is positioned within recessed portions (233) of back (214) and second arm (224). At least one of fastener (304) or first leg (298) contacts back (214), and second leg (300) contacts second arm (224). FIG. 20D shows base (212), back (214), and second arm (224) connected together using brackets (226, 228, 230).

Figure 20E:
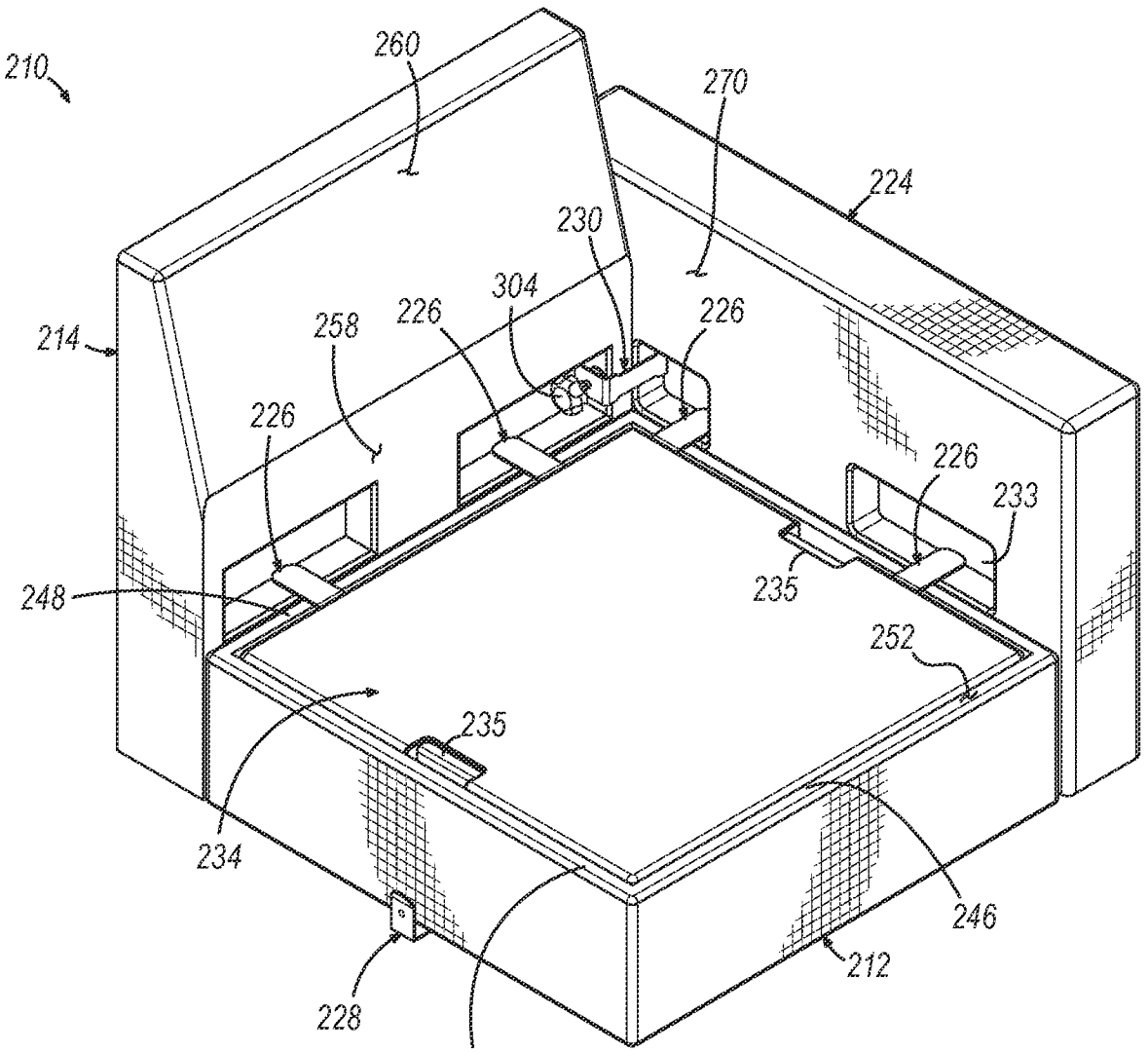
FIG. 20E depicts a perspective view of a suspension assembly being inserted into a cavity of the base and supported by a portion of the brackets.

FIG. 20E shows suspension assembly (234) inserted into cavity (232) of base (212) and supported by second portions (274) of brackets (226). Suspension assembly (234) may be set into place using handles (235) of suspension assembly (234). Two brackets (226) are shown as connecting second arm (224) to base (212) and also simultaneously supporting removable seat (216) within cavity (232) of base (212). Suspension assembly (234) is configured to contact second portion (274). Supporting portion (285) is configured to support suspension assembly (234) within cavities (232) of bases (212*a-f*). Retaining portion (287) extends generally perpendicular to supporting portion (285) and is configured to retain suspension assembly (234) within supporting portion (285).

Figure 20F:
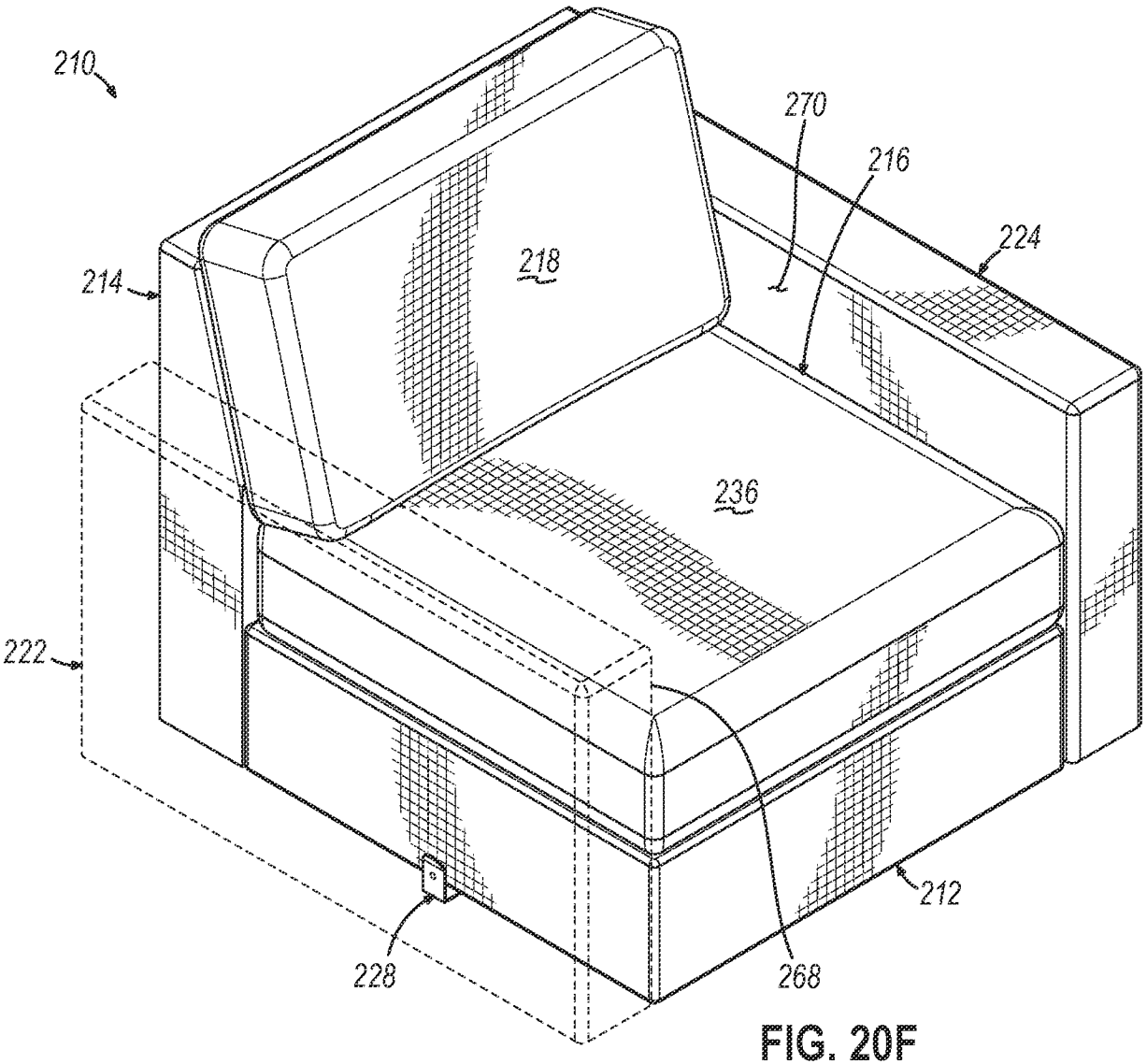
FIG. 20F depicts a perspective view of the modular furniture assembly in an assembled state with a first arm being shown in dashed lines.

FIG. 20F shows modular furniture assembly (210) in an assembled state with first arm (222) being shown in dashed lines. First arm (222) may be connected with base (212) using brackets (226, 228), similar to that of second arm (224) described in detail above. Similarly, first arm (222) may be connected with back (214) using bracket (230), similar to that of second arm (224) described in detail above. Modular furniture assembly (210) may be disassembled in a reverse order comparted to the method of assembly described above with reference to FIGS. 20A-20E. Modular furniture assembly (210) may be repeatedly assembled and disassembled.

Figure 21:
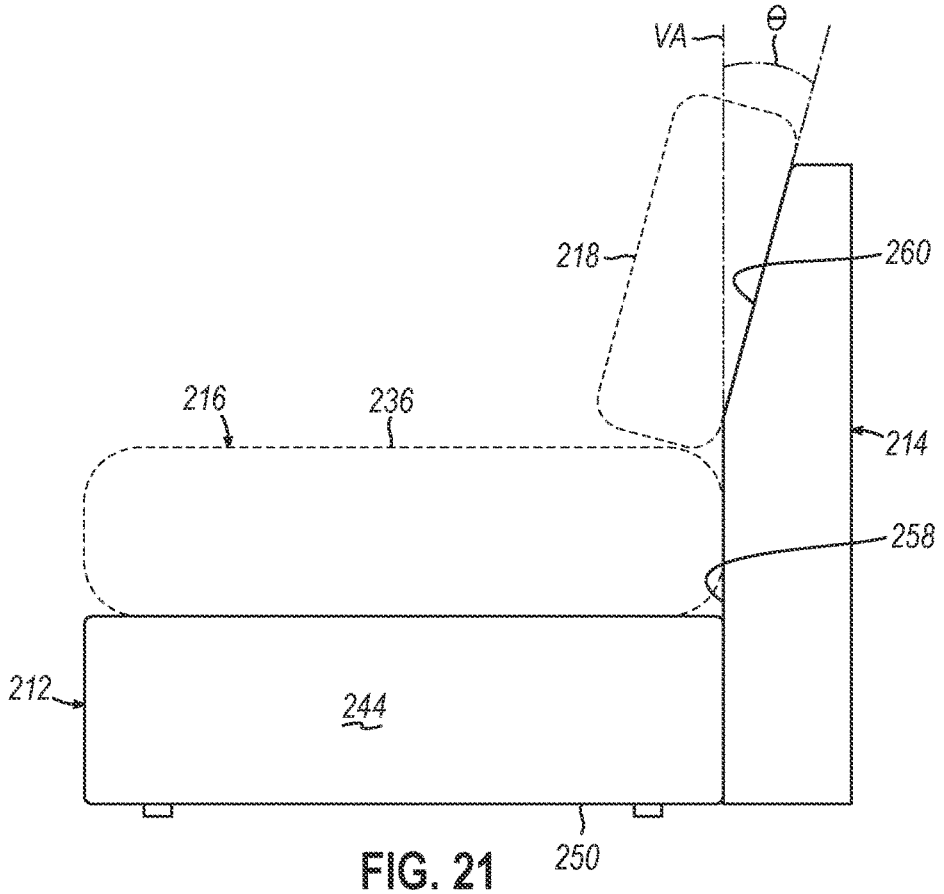
FIG. 21 depicts a schematic side view of the back including a tapered portion.

FIG. 21 shows a schematic side view of base (212) connected with back (214), with back (214) including tapered surface (260). Tapered surface (260) causes back cushion (218) to be angled at angle (Θ) relative to a vertical axis (VA). Angling back cushion (218) may allow for the user to be more comfortable while sitting on modular furniture assembly (210).

Figure 22:
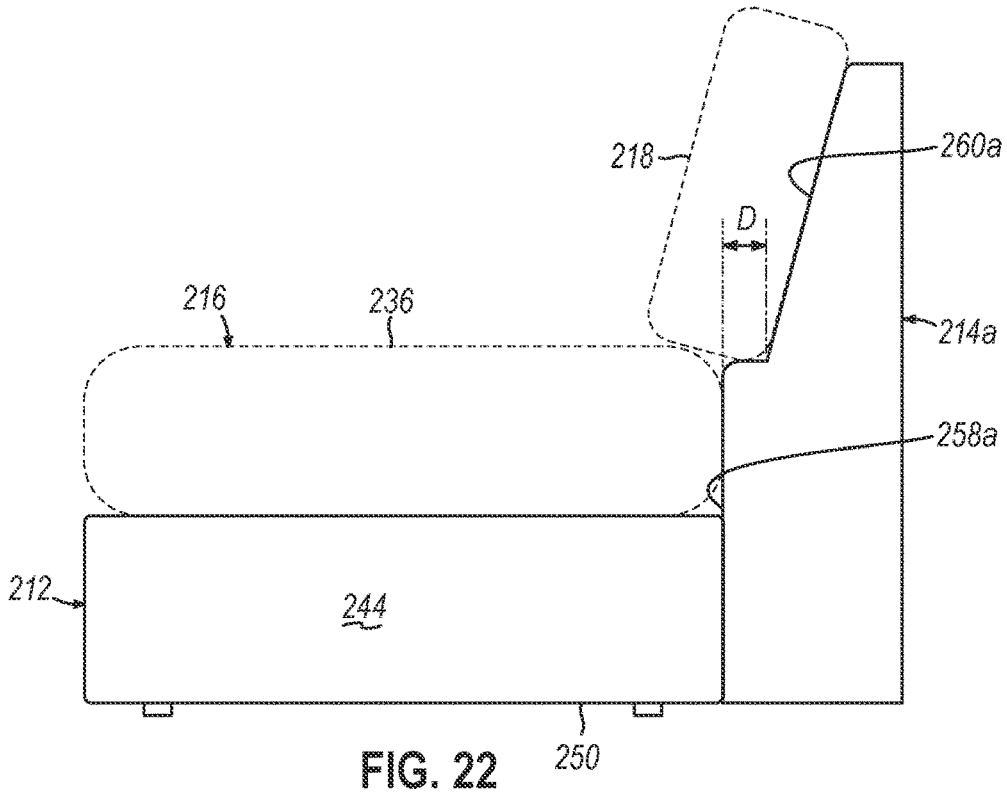
FIG. 22 depicts a schematic side view of another exemplary back that includes a recessed tapered portion.

FIG. 22 shows a schematic side view of another exemplary back (214*a*) that includes an inner facing surface (258*a*), a tapered surface (260*a*) and a recess (261*a*). Using back (214*a*), back cushion (218) is recessed a distance (D) as compared to back (214). Back (214*a*) may allow for additional depth to be obtained without increasing the dimensions of base (212) of modular furniture assembly (210). Back (214*a*) also allows for additional user customization. While FIGS. 21 and 22 show backs (214, 214*a*) having a flat top surface, it is also envisioned that this top surface may be arcuate.

D. Exemplary Alternative Arms

Figure 23A:
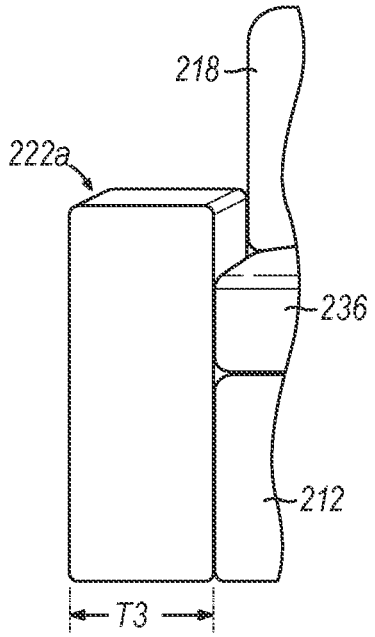
FIG. 23A depicts a schematic perspective view of a first exemplary alternative arm.
Figure 23B:
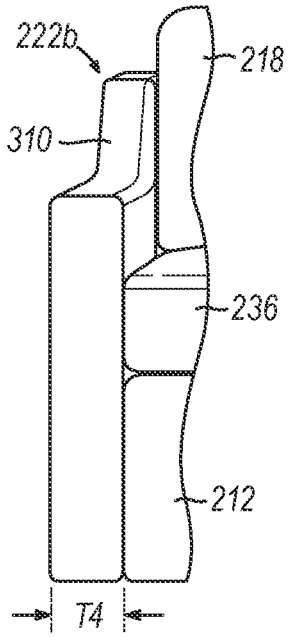
FIG. 23B depicts a schematic perspective view of a second exemplary alternative arm.
Figure 23C:
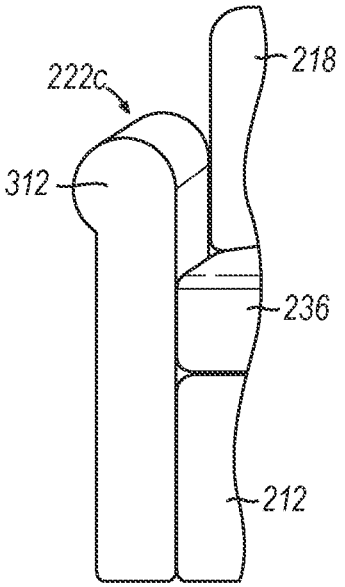
FIG. 23C depicts a schematic perspective view of a third exemplary alternative arm.

FIGS. 23A-23F show various exemplary alternative arms (222*a-f*). Particularly, FIG. 23A shows a schematic perspective view of a first exemplary alternative arm (222*a*). Arm (222*a*) has a third thickness (T3). FIG. 23B shows a schematic perspective view of a second exemplary alternative arm (222*b*). Arm (222*b*) has a fourth thickness (T4) that is greater than third thickness (T3). Unlike arm (222*a*), arm (222*b*) has an upwardly extending portion (310). FIG. 23C shows a schematic perspective view of a third exemplary alternative arm (222*c*). Arm (222*c*) has a rounded upper surface (312).

Figure 23D:
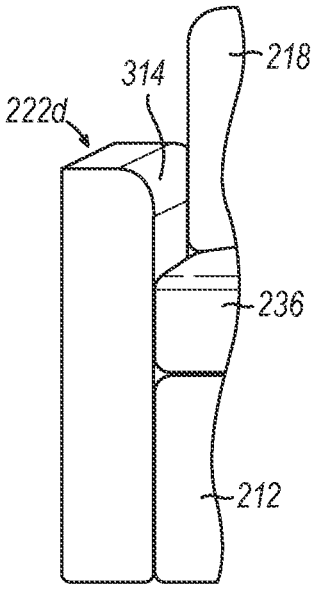
FIG. 23D depicts a schematic perspective view of a fourth exemplary alternative arm.
Figure 23E:
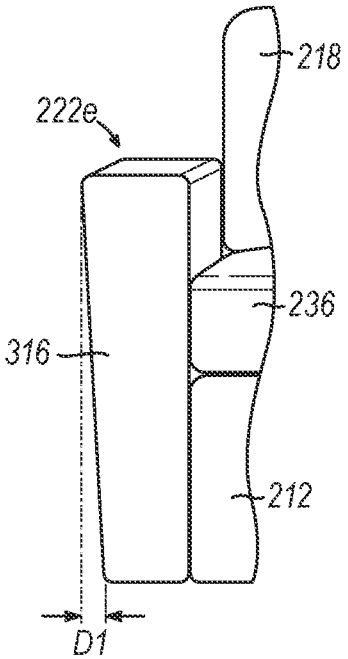
FIG. 23E depicts a schematic perspective view of a fifth exemplary alternative arm.
Figure 23F:
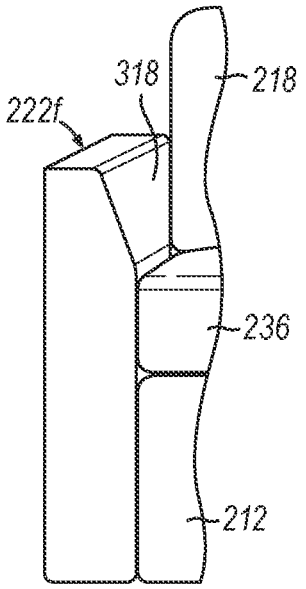
FIG. 23F depicts a schematic perspective view of a sixth exemplary alternative arm.

FIG. 23D shows a schematic perspective view of a fourth exemplary alternative arm (222*d*). Arm (222*d*) has a filleted inner surface (314) adjacent base (212). FIG. 23E shows a schematic perspective view of a fifth exemplary alternative arm (222*e*). Arm (222*e*) includes a cantilevered outer surface (316) that projects outwardly away from base (212). Cantilevered outer surface (316) extends outwardly a distance (D1). FIG. 23F shows a schematic perspective view of a sixth exemplary alternative arm (222*f*). Arm (222*f*) has a chamfered inner surface (318) adjacent base (212).

E. Exemplary User Convenience Feature

Figure 24A:
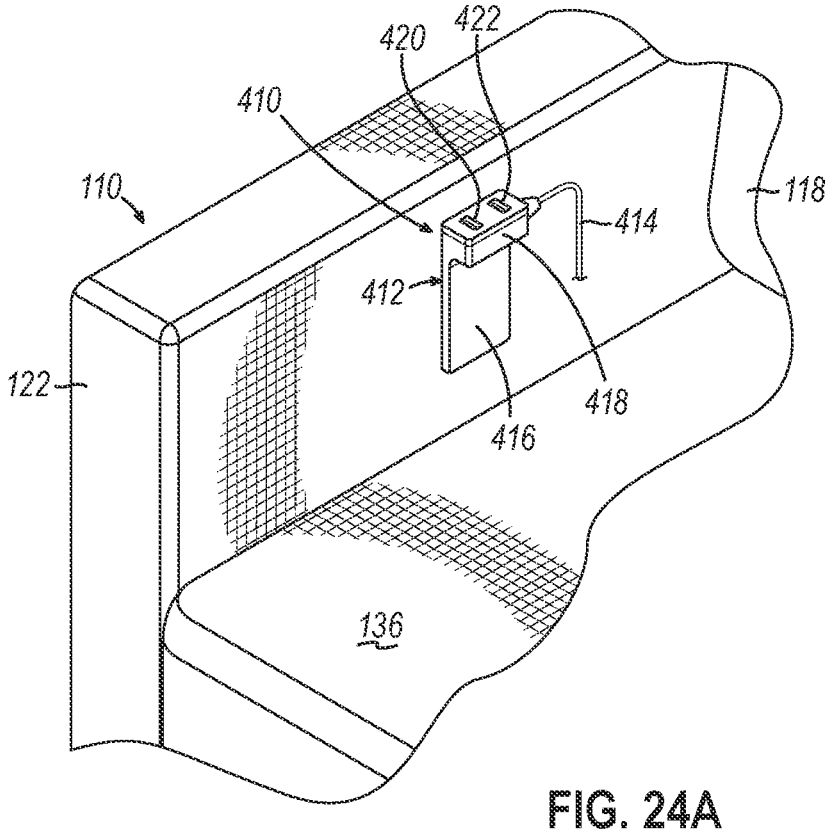
FIG. 24A depicts a perspective view of a portion of the modular furniture assembly of FIG. 13, but prior to a removable user convenience feature being fully inserted.
Figure 24B:
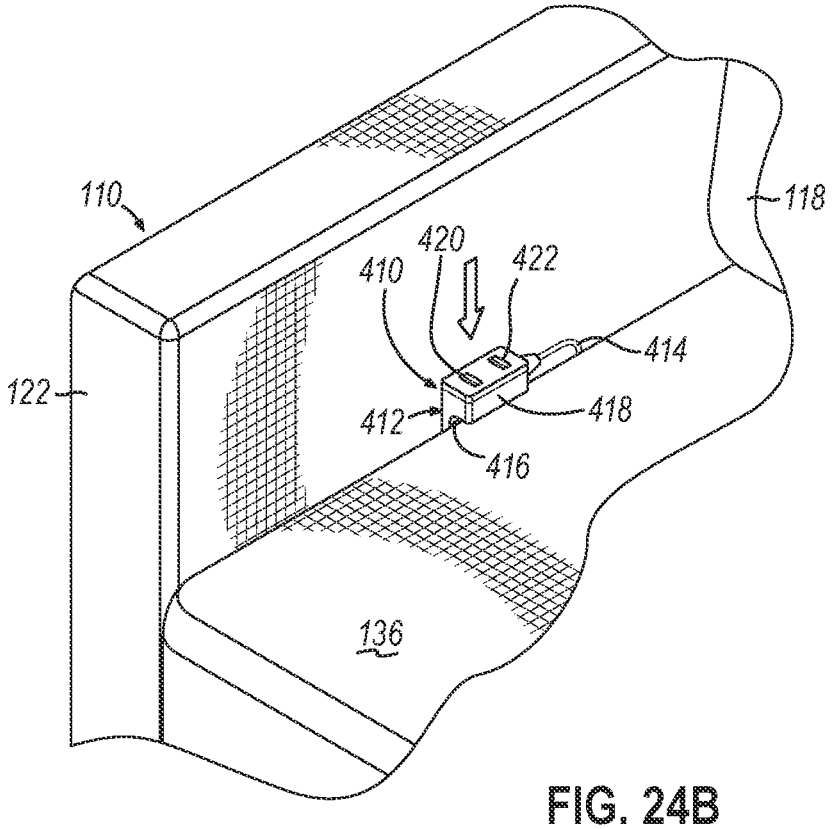
FIG. 24B depicts a perspective view of the portion of the modular furniture assembly of FIG. 24A, but with a removable user convenience feature fully inserted.

FIG. 24A-24B show a portion of modular furniture assembly (110) of FIG. 13, but with a removable user convenience feature (410) inserted into modular furniture assembly (110). As shown, removable user convenience feature (410) includes a body (412) and a cord (414) extending from body (412). Cord (414) extends between body (412) and an electrical outlet (not shown). Body (412) includes first and second portions (416, 418) that collectively form an L-shape.

In FIG. 24B, first portion (416) is shown as being positioned between first arm (122) and bottom cushion (136). While not shown, first portion (416) may be alternatively positioned between base (112*a-f*) and the respective back (114*a-f*), or between second arm (124) and base (112*f*).

Second position (418) is configured to rest on bottom cushion (136) with cord (414) extending therefrom towards back (114*a*). Second portion (418) includes first and second power sources, which are shown as first and second USB drives (420, 422). First and second USB drives (420, 422) may allow user(s) to charge their electronic devices without the hassle of locating an electrical wall outlet which may be hidden behind modular furniture assembly (110) in a hard-to-reach position.

F. Exemplary Insertable Storage Section

Figure 25A:
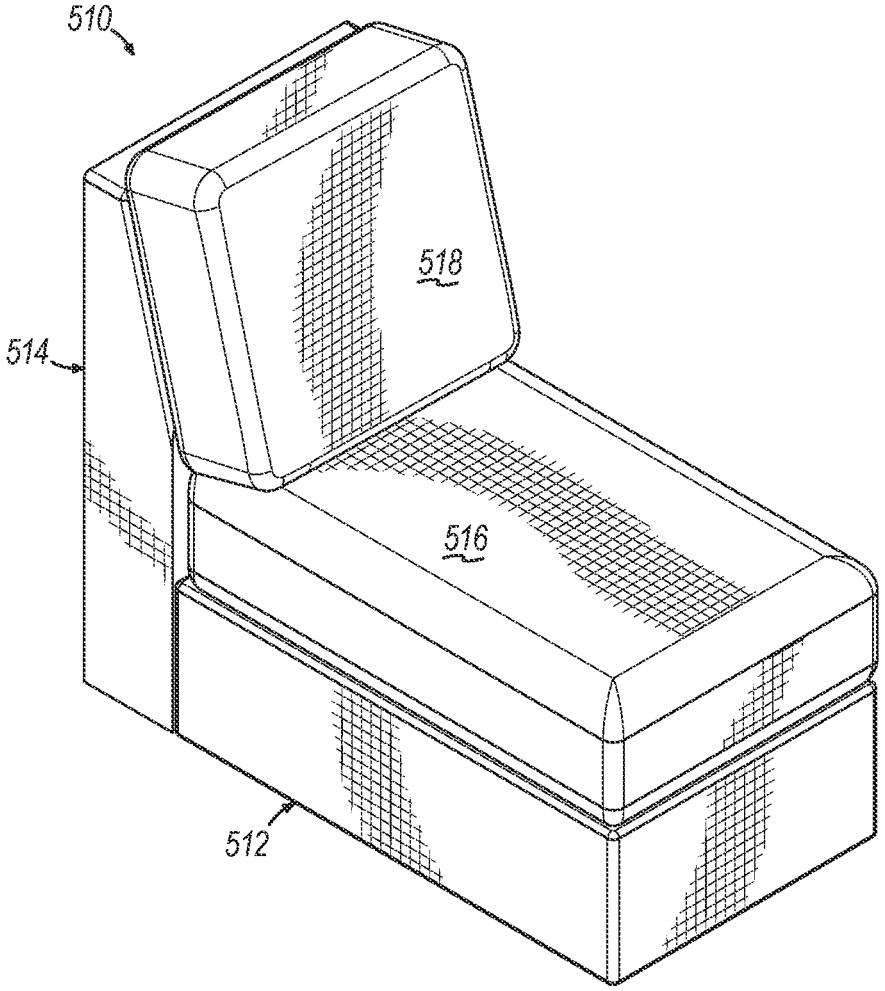
FIG. 25A depicts a perspective view of an exemplary insertable storage section.
Figure 25B:
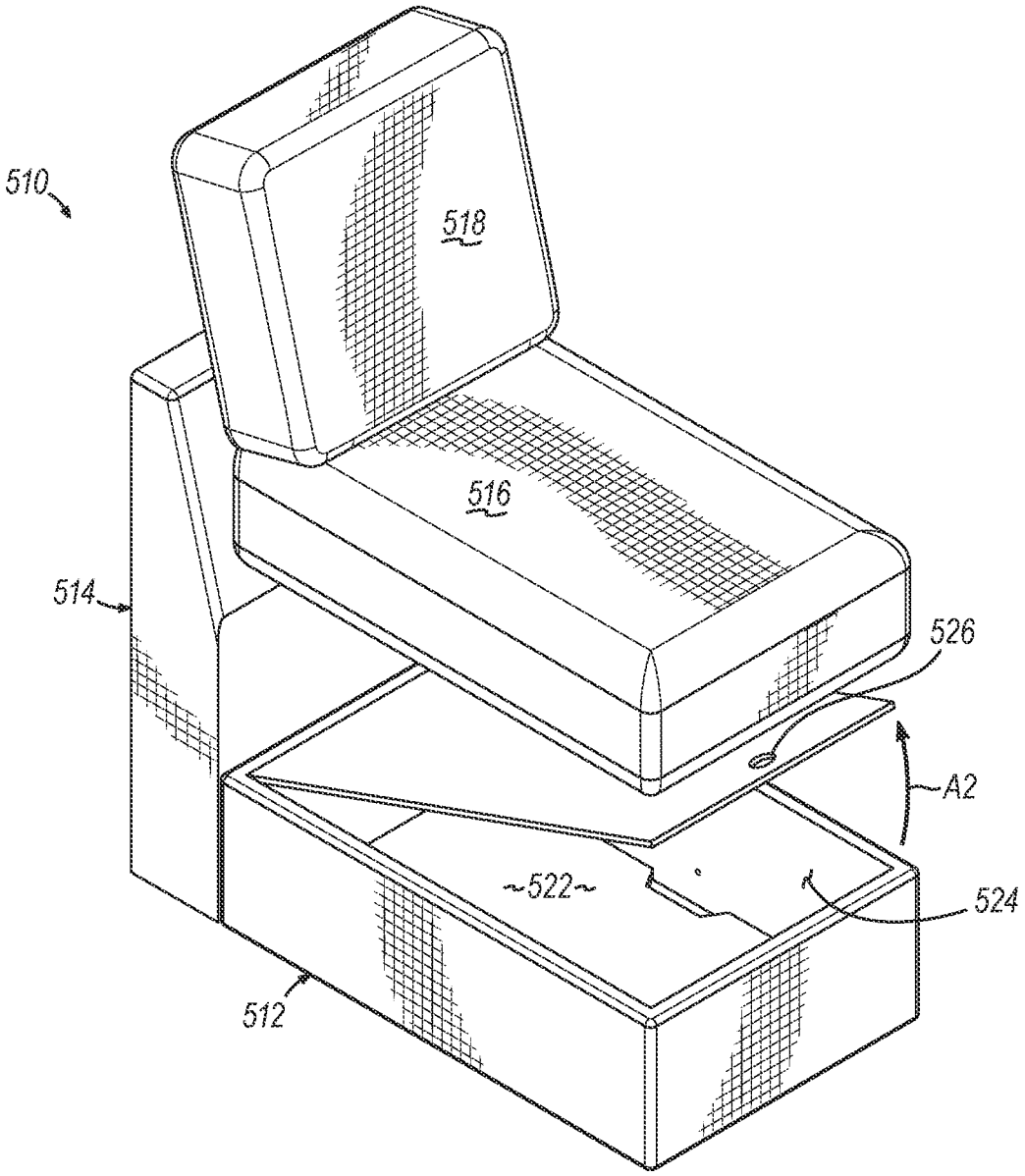
FIG. 25B depicts a perspective view of the insertable storage section of FIG. 25A, but with the back cushion and bottom cushion moved upward to reveal a storage compartment in a base.
Figure 25C:
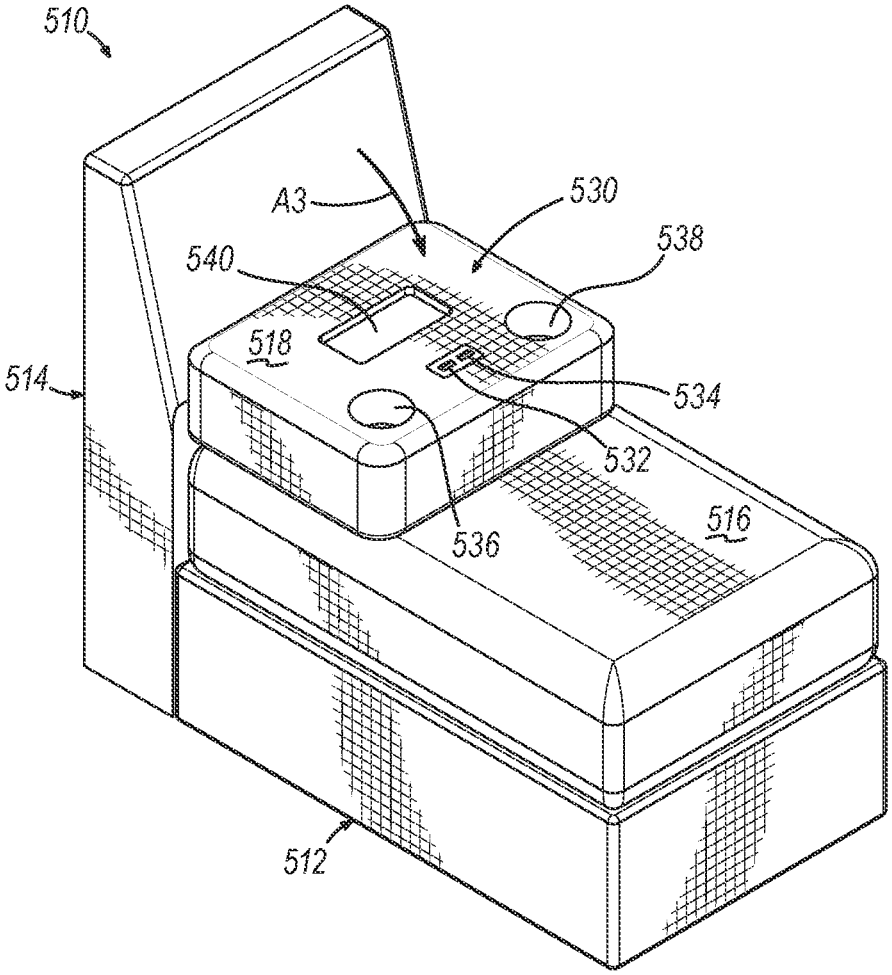
FIG. 25C depicts a perspective view of the insertable storage section of FIG. 25B, but with the back cushion folded downward to reveal user convenience features.

FIGS. 25A-25C shows an exemplary insertable storage section (510) that may be insertable into a portion of modular furniture assembly (10, 110, 210). Insertable storage section (510) includes a base (512), a back (514), a bottom cushion (516), and a back cushion (518). Base (512) may be connected with any of bases (12, 112*a-f*, 212). Particularly, FIG. 25A shows insertable storage section (510) in an assembled state, and FIG. 25B shows insertable storage section (510) with bottom cushion (516) and back cushion (518) moved upward as illustrated by arrow (A2) to reveal a storage compartment (520) positioned within base (512). Base (512) includes inner surfaces (524) that together with a lid (522) collectively define storage compartment (520). Lid (522) may be opened using an aperture (526) or through a handle.

Insertable storage section (510) includes a drop-down portion (528) configured to pivot relative to base (512) between a first configuration shown in FIG. 25A and a second configuration shown in FIG. 25C. As shown in the second configuration of FIG. 25C, back cushion (518) is folded downward as illustrated by arrow (A3) to reveal user convenience features (530). User convenience features (530) include first and second USB drives (532, 534), first and second cup holders (536, 538), and a receptacle (540). Additional user convenience features (530) may also be included.

G. Exemplary Alternative Suspension Assembly

Figure 26A:
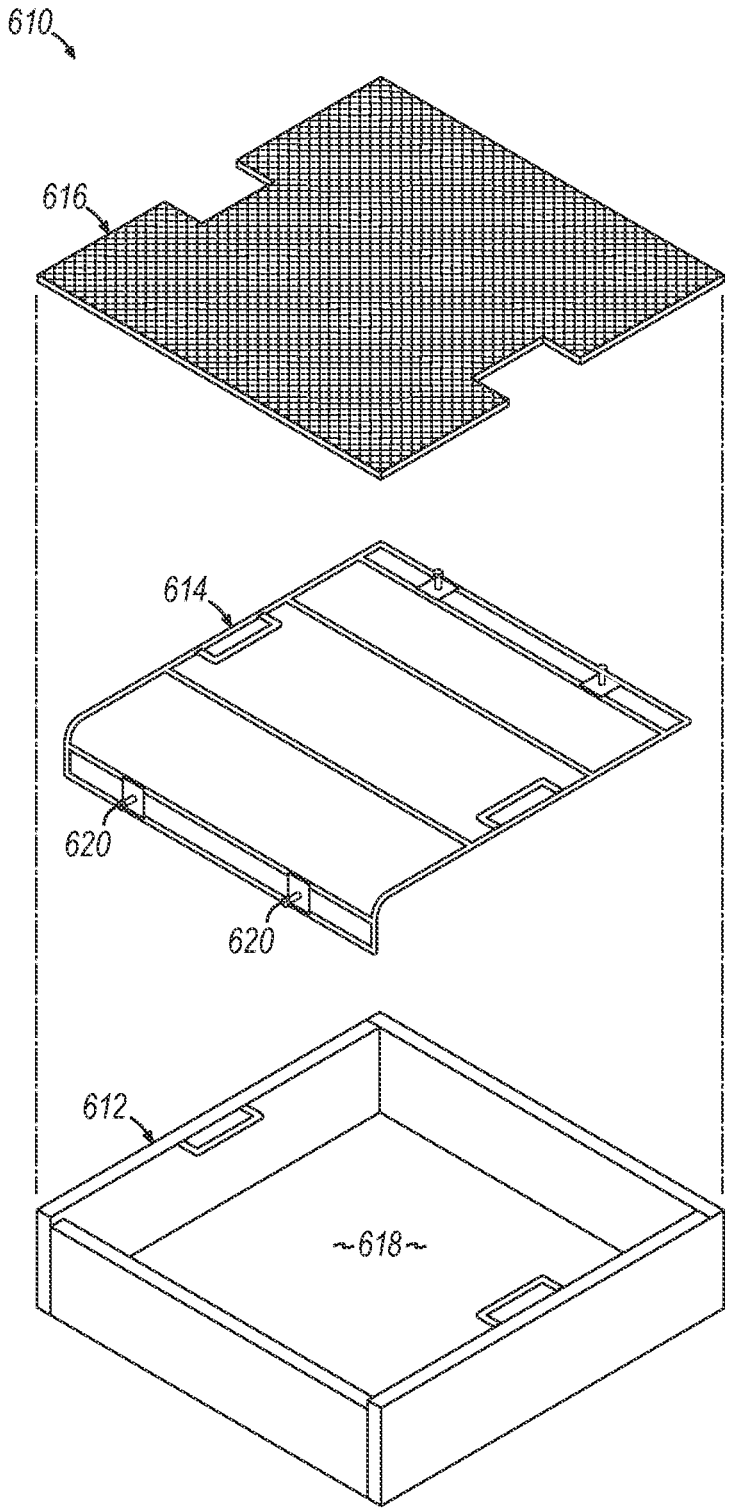
FIG. 26A depicts an exploded perspective view of an alternative exemplary suspension assembly.
Figure 26B:
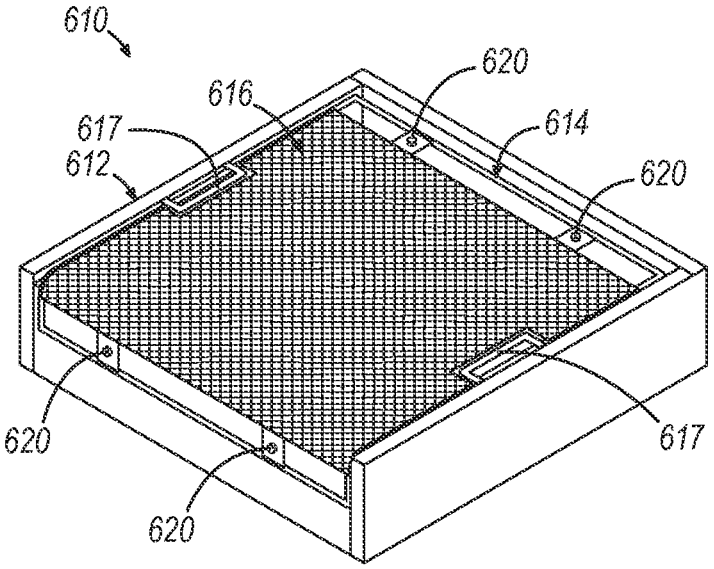
FIG. 26B shows a perspective view of the suspension assembly of FIG. 26A.

FIGS. 26A-26B show an alternative exemplary suspension assembly (610) for use with bases (12, 112*a-f*, 212) instead of suspension assemblies (20, 134, 234). Similar to suspension assemblies (20, 134, 234), suspension assembly (610) may be set into bases (12, 112*a-f*, 212). Different types of suspension assemblies (20, 134, 234, 610) may be used in combination with each other. As shown in FIG. 26A, suspension assembly (610) includes a body (612), a frame (614), and a mesh fabric (616). Body (612) includes handles (617) to allow for suspension assembly (610) be easily dropped into place. Body (612) defines a cavity (618) configured to receive frame (614). Frame (614) may be secured with body (612) and/or mesh fabric (616) using one or more fasteners (620). In some versions, mesh fabric (616) may include a stretchable fabric such as Ilira®, which is commercially available from H.R. Rathgeber GmbH & Co. KG of Herbrechtingen, Germany. However, other types of mesh fabric (616) are also envisioned. Mesh fabric (616) may be wrapped around frame (614) and secured using a variety of suitable securement structures. Mesh fabric (616) may provide enhanced comfort and support to the user while also being lightweight.

H. Exemplary Alternative Suspension Assembly

Figure 27:
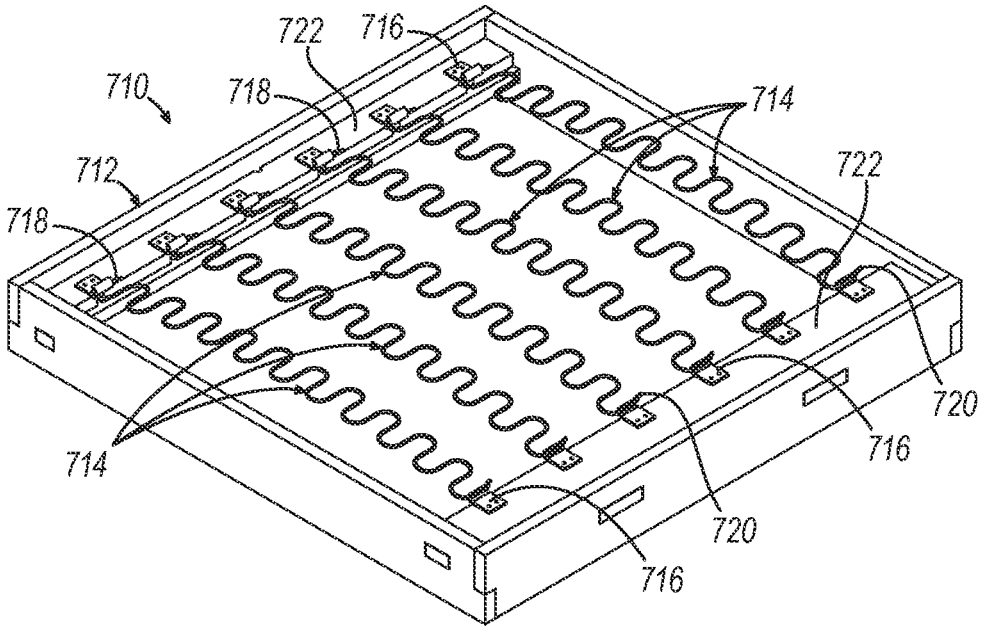
FIG. 27 depicts a perspective view of another alternative exemplary suspension assembly.
Figure 28:
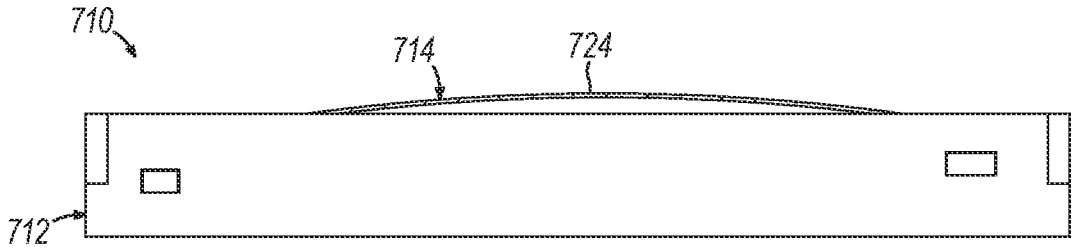
FIG. 28 shows a front elevational view of the suspension assembly of FIG. 27.

FIGS. 27-28 show another exemplary alternative suspension assembly (710) for use with bases (12, 112*a-f*, 212) instead of suspension assemblies (20, 134, 234, 610). Similar to suspension assemblies (20, 134, 234, 610), suspension assembly (710) may be set into bases (12, 112*a-f*, 212). Different types of suspension assemblies (20, 134, 234, 610, 710) may be used in combination with each other. As shown in FIG. 27, suspension assembly (710) includes a body (712), a plurality of springs (714), and attachment features (716). Body (712) may include handles (not shown) to allow for suspension assembly (710) be easily dropped into place. Springs (714) include opposing first and second ends (718, 720). First end (718) is connected with a cross-member (722) of body (712) using attachment feature (716). Similarly, second end (720) is connected with another cross-member (722) of body (712) using another attachment feature (716). Springs (714) are shown as sinuous springs; however, other springs are also envisioned including coil springs. While six springs (714) are shown, more or fewer springs (714) are also envisioned. As shown in FIG. 28, springs (714) are flexed away from body (712) peaking at a center point (724). This curvature away from body (712) may prevent a user from sinking into base (12, 112*a-f*, 212) when the user is sitting on bottom cushion (136, 236) that is supported by suspension assembly (710). In some versions, spring (716) may flatten out (i.e., have a reduced curvature) when being sat on by a user. While not shown, an optional fabric may cover springs (714). Springs (714) may provide enhanced comfort and support to the user while also being lightweight.

II. EXEMPLARY COMBINATIONS

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A modular furniture assembly comprising: (a) a base that defines an interior cavity; (b) a back; (c) a removable seat; and (d) a first bracket comprising: (i) a first portion configured to connect the back with the base, and (ii) a second portion configured to support the removable seat within the interior cavity of the base.

Example 2

The modular furniture assembly of Example 1, wherein the first portion comprises: (i) a projection extending along a first axis, (ii) an intermediate portion extending along a second axis that is parallel to and offset from the first axis, and (iii) a connecting portion that joins the projection with the intermediate portion.

Example 3

The modular furniture assembly of Example 2, wherein the base includes an outer surface, wherein the back includes an inner facing surface, wherein the projection, the intermediate portion, and the connecting portion are configured to force the outer surface of the base against the inner facing surface of the back.

Example 4

The modular furniture assembly of any one or more of the preceding Examples, wherein the first bracket has an S-shape.

Example 5

The modular furniture assembly of any one or more of the preceding Examples, wherein the first bracket, including the first and second portions, are integrally formed together as a unitary piece.

Example 6

The modular furniture assembly of any one or more of the preceding Examples, wherein the first bracket includes a pin, wherein the back includes a slot configured to receive the pin.

Example 7

The modular furniture assembly of Example 6, wherein the back includes a recessed portion that includes the slot, wherein the slot of the recessed portion is configured to receive the pin.

Example 8

The modular furniture assembly of any one or more of the preceding Examples, further comprising a second bracket spaced a distance from the first bracket, the second bracket comprising: (i) a first portion configured to connect the back to the base, and (ii) a second portion configured to support the removable seat within the interior cavity of the base.

Example 9

The modular furniture assembly of any one or more of Examples 1 through 7, further comprising: (a) a first arm; and (b) a second bracket comprising: (i) a first portion configured to connect the first arm with the base, and (ii) a second portion configured to support the removable seat within the interior cavity of the base.

Example 10

The modular furniture assembly of any one or more of Examples 1 through 8, further comprising a first arm having a first thickness, wherein the back has a second thickness that is different than the first thickness of the first arm.

Example 11

The modular furniture assembly of any one or more of the preceding Examples, the removable seat comprising: (i) a bottom cushion configured to support a user, and (ii) a suspension assembly configured to contact the second portion, wherein the suspension assembly supports the suspension assembly.

Example 12

The modular furniture assembly of any one or more of the preceding Examples, wherein the back includes a tapered portion that is angled in a first direction away from the base.

Example 13

The modular furniture assembly of any one or more of the preceding Examples, further comprising a corner section, the corner section comprising: (i) a first tapered portion that is angled away from the base in a first direction, and (ii) a second tapered portion that is angled from away the base in a second direction.

Example 14

The modular furniture assembly of any one or more of the preceding Examples, further comprising a second base connected with the base, wherein the second base includes an insertable storage section, wherein the insertable storage section includes a drop-down portion configured to pivot relative to the second base between a first configuration and a second configuration.

Example 15

The modular furniture assembly any one or more of the preceding Examples, wherein the base includes a bottom surface, a top surface, and an inner surface, wherein the first bracket is configured to extend along a portion of the top surface of the base, the modular furniture assembly further comprising a second bracket configured to connect to the back of the modular furniture assembly and to the inner surface of the base, wherein the second bracket is configured to extend along a portion of the bottom surface of the base.

Example 16

The modular furniture assembly of Example 15, further comprising a threaded fastener configured to adjustably secure the second bracket against the inner surface of the base.

Example 17

A modular furniture assembly comprising: (a) a base that includes a bottom surface, a top surface, and an inner surface; (b) a back; (c) a first bracket configured to connect the back over the top surface of the base; and (d) a second bracket configured to connect to the back and the inner surface of the base, wherein the second bracket extends along a portion of the bottom surface of the base.

Example 18

The modular furniture assembly of Example 17, further comprising a threaded fastener configured to adjustably secure the second bracket against the inner surface of the base.

Example 19

A method of assembling a modular furniture assembly, wherein the modular furniture assembly includes a base, a back, a removable seat, and a first bracket, the method comprising: (a) attaching a first portion of the first bracket to the back so that a gap exists between a second portion of the first bracket and the back; (b) inserting a portion of the base into the gap to force the base against the back; and (c) inserting the removable seat into the base which is supported by the second portion.

Example 20

The method of Example 19, wherein the modular furniture assembly includes a first arm, wherein the first arm includes a recessed portion, wherein the back includes a recessed portion, the method further comprising connecting the first arm with the back by attaching a second bracket between a wall of the recessed portion of the first arm and a wall of the of the recessed portion of the back.

III. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A modular furniture assembly comprising:
(a) a base that defines an interior cavity;
(b) a back that includes a slot;
(c) a removable seat; and
(d) a first bracket comprising:
(i) a first portion configured to connect the back with the base, wherein the first portion includes a projection, wherein the slot of the back is configured to receive the projection, and
(ii) a second portion configured to support the removable seat within the interior cavity of the base.

2. The modular furniture assembly of claim 1, wherein the first portion comprises:
(i) the projection extending along a first axis,
(ii) an intermediate portion extending along a second axis that is parallel to and offset from the first axis, and
(iii) a connecting portion that joins the projection with the intermediate portion.

3. The modular furniture assembly of claim 2, wherein the base includes an outer surface, wherein the back includes an inner facing surface, wherein the projection, the intermediate portion, and the connecting portion are configured to force the outer surface of the base against the inner facing surface of the back.

4. The modular furniture assembly of claim 2, wherein the first bracket has an S-shape.

5. The modular furniture assembly of claim 1, wherein the first bracket, including the first and second portions, are integrally formed together as a unitary piece.

6. The modular furniture assembly of claim 1, wherein the projection includes a pin, wherein the back includes a recessed portion that includes the slot, wherein the slot of the recessed portion is configured to receive the pin.

7. The modular furniture assembly of claim 1, further comprising a second bracket spaced a distance from the first bracket, the second bracket comprising:
(i) a first portion configured to connect the back to the base, and
(ii) a second portion configured to support the removable seat within the interior cavity of the base.

8. The modular furniture assembly of claim 1, further comprising:
(a) a first arm; and
(b) a second bracket comprising:
(i) a first portion configured to connect the first arm with the base, and
(ii) a second portion configured to support the removable seat within the interior cavity of the base.

9. The modular furniture assembly of claim 1, further comprising a first arm having a first thickness, wherein the back has a second thickness that is different than the first thickness of the first arm.

10. The modular furniture assembly of claim 1, the removable seat comprising:
(i) a bottom cushion configured to support a user, and
(ii) a suspension assembly configured to contact the second portion, wherein the suspension assembly supports the bottom cushion.

11. The modular furniture assembly of claim 1, wherein the back includes a tapered portion that is angled in a first direction away from the base.

12. The modular furniture assembly of claim 1, further comprising a corner section, the corner section comprising:
(i) a first tapered portion that is angled away from the base in a first direction, and
(ii) a second tapered portion that is angled from away the base in a second direction.

13. The modular furniture assembly of claim 1, further comprising a second base connected with the base, wherein the second base includes an insertable storage section, wherein the insertable storage section includes a drop-down portion configured to pivot relative to the second base between a first configuration and a second configuration.

14. The modular furniture assembly of claim 1, wherein the base includes a bottom surface, a top surface, and an inner surface, wherein the first bracket is configured to extend along a portion of the top surface of the base, the modular furniture assembly further comprising a second bracket configured to connect to the back of the modular furniture assembly and to the inner surface of the base, wherein the second bracket is configured to extend along a portion of the bottom surface of the base.

15. The modular furniture assembly of claim 14, further comprising a threaded fastener configured to adjustably secure the second bracket against the inner surface of the base.

16. A method of assembling a modular furniture assembly, wherein the modular furniture assembly includes a base, a back, a removable seat, a first bracket, and a first arm, wherein the first arm includes a recessed portion, wherein the back includes a recessed portion, the method comprising:

(a) attaching a first portion of the first bracket to the back so that a gap exists between a second portion of the first bracket and the back;

(b) inserting a portion of the base into the gap to force the base against the back;

(c) connecting the first arm with the back by attaching a second bracket between a wall of the recessed portion of the first arm and a wall of the recessed portion of the back, and (d) inserting the removable seat into the base which is supported by the second portion.

17. A modular furniture assembly comprising:

(a) a base that defines an interior cavity;

(b) a back;

(c) a removable seat; and (d) a first bracket comprising:

(i) a first portion configured to connect the back with the base, the first portion comprising:

(A) a projection extending along a first axis, (B) an intermediate portion extending along a second axis that is parallel to and offset from the first axis, and (C) a connecting portion that joins the projection with the intermediate portion, and (ii) a second portion configured to support the removable seat within the interior cavity of the base.

18. The modular furniture assembly of claim 17, wherein the base includes an outer surface, wherein the back includes an inner facing surface, wherein the projection, the intermediate portion, and the connecting portion are configured to force the outer surface of the base against the inner facing surface of the back.

* * * * *